US007920098B2

(12) United States Patent
Harano

(10) Patent No.: US 7,920,098 B2
(45) Date of Patent: Apr. 5, 2011

(54) ANTENNA DEVICE FOR PORTABLE TERMINALS AND RADIO UNIT FOR RECEIVING BROADCAST WAVES

(75) Inventor: Nobuya Harano, Kakegawa (JP)

(73) Assignee: NEC Corporation, Tokyo (JP)

( * ) Notice: Subject to any disclaimer, the term of this patent is extended or adjusted under 35 U.S.C. 154(b) by 292 days.

(21) Appl. No.: 12/239,946

(22) Filed: Sep. 29, 2008

(65) Prior Publication Data

US 2009/0096684 A1 Apr. 16, 2009

Related U.S. Application Data

(62) Division of application No. 10/573,080, filed on Mar. 23, 2006, now abandoned.

(30) Foreign Application Priority Data

Sep. 26, 2003 (JP) ..... 2003-335972
Nov. 21, 2003 (JP) ..... 2003-392271

(51) Int. Cl.
*H01Q 1/24* (2006.01)

(52) U.S. Cl. ..... 343/702; 343/895

(58) Field of Classification Search ..... 343/702, 343/895

See application file for complete search history.

(56) References Cited

U.S. PATENT DOCUMENTS

| | | | | |
|---|---|---|---|---|
| 7,130,591 | B2 * | 10/2006 | Iwai et al. | 455/90.3 |
| 2007/0052595 | A1 * | 3/2007 | Harano | 343/702 |
| 2009/0096685 | A1 * | 4/2009 | Harano | 343/702 |

FOREIGN PATENT DOCUMENTS

| | | | |
|---|---|---|---|
| JP | 1973-20349 | | 3/1973 |
| JP | 49-69004 | | 7/1974 |
| JP | 58-191741 | U | 12/1983 |
| JP | 59-219028 | A | 12/1984 |
| JP | 61-281724 | A | 12/1986 |
| JP | 4-200047 | A | 7/1992 |
| JP | 5-304408 | A | 11/1993 |
| JP | 7-50843 | B2 | 5/1995 |
| JP | 7-307694 | A | 11/1995 |
| JP | 8-70215 | A | 3/1996 |
| JP | 2569649 | B2 | 10/1996 |
| JP | 9-148824 | A | 6/1997 |
| JP | 9-148827 | A | 6/1997 |
| JP | 9-199917 | A | 7/1997 |
| JP | 9-270836 | A | 10/1997 |
| JP | 10-22730 | A | 1/1998 |
| JP | 10-51224 | A | 2/1998 |
| JP | 10-79615 | A | 3/1998 |
| JP | 11-4113 | A | 1/1999 |

(Continued)

*Primary Examiner* — Tho G Phan
(74) *Attorney, Agent, or Firm* — Sughrue Mion, PLLC

(57) ABSTRACT

There is provided an antenna device for use with a portable terminal, which can be used in different frequency bands by combining antenna characteristics.

Whip antenna is electrically connected to power feeder through contact member, and resonates in a UHF band or higher when extended. Coiled antenna is electrically connected to power feeder through frequency filter mounted on device board. Frequency filter is set to a low impedance in a VHF band to supply electric power to coiled antenna. With this arrangement, external whip antenna is excited in the UHF band or higher, and built-in coiled antenna is mainly excited in the VHF band. The antenna device is thus capable of sending or receiving radio waves in a wide frequency band.

27 Claims, 18 Drawing Sheets

FOREIGN PATENT DOCUMENTS

| | | | |
|---|---|---|---|
| JP | 11-88037 | A | 3/1999 |
| JP | 11-298229 | A | 10/1999 |
| JP | 11-317612 | A | 11/1999 |
| JP | 2000-278014 | A | 10/2000 |
| JP | 3119553 | B2 | 10/2000 |
| JP | 2000-516056 | A | 11/2000 |
| JP | 2001-251232 | A | 9/2001 |
| JP | 2001-274620 | A | 10/2001 |
| JP | 2002-64329 | A | 2/2002 |
| JP | 2002-76982 | A | 3/2002 |
| JP | 2002-171315 | A | 6/2002 |
| JP | 2002-176373 | A | 6/2002 |
| JP | 3339967 | B2 | 8/2002 |
| JP | 2002-314450 | A | 10/2002 |
| JP | 2002-325015 | A | 11/2002 |
| JP | 2003-37418 | A | 2/2003 |
| JP | 2003-60416 | A | 2/2003 |
| JP | 2003-87023 | A | 3/2003 |
| JP | 2003-124719 | A | 4/2003 |
| JP | 2003-124853 | A | 4/2003 |
| JP | 2003-124854 | A | 4/2003 |
| JP | 2003-153111 | A | 5/2003 |
| JP | 2003-244015 | A | 8/2003 |

* cited by examiner

ANTENNA DEVICE FOR PORTABLE TERMINALS AND RADIO UNIT FOR RECEIVING BROADCAST WAVES

This is a divisional of application Ser. No. 10/573,080 filed Mar. 23, 2006 now abandoned. The entire disclosure(s) of the prior application(s), application number(s) 10/573,080 is hereby incorporated by reference.

TECHNICAL FIELD

The present invention relates to an antenna device for use with a portable terminal, which comprises a combination of antennas for allowing the antenna device to be used in different frequency bands, and more particularly to a radio unit which is capable of receiving TV broadcast waves and FM broadcast waves in UHF and VHF bands.

BACKGROUND ART

As disclosed in Patent Document 1 (JP-A No. 5-304408), a conventional antenna device for portable terminals comprises a combination of an extensible and contractible external antenna which provides a high gain when extended and a greatly lowered gain when contracted, and a built-in antenna which provides a gain that is better than the external antenna as it is contracted, but lower than the external antenna as it is extended. The disclosed conventional antenna device provides good gains for transmitting and receiving radio waves, and can be used at two frequencies.

Many radio units and receivers that are commercially available at present which are compatible with frequencies in the VHF frequency band and frequencies in the UHF band employ a rod antenna, a helical antenna, or the like because wavelengths are quite long in the VHF band.

Radio units and receivers that are designed for better portability often employ earphones as an antenna.

JP-A No. 04-200047 (Patent Document 2) discloses an arrangement having two pairs of antennas disposed between two earphones and a cellular phone and selectively switchable by a switcher.

JP-A No. 61-281724 (Patent Document 3) discloses an arrangement which employs an earphone cord as a second antenna for diversity reception.

JP-A No. 2002-314450 (Patent Document 4) discloses an arrangement which employs earphone wires as two antennas and switches from one of the earphone wires to the other in the event of a reception failure during reception using one earphone wire.

Patent Document 1: JP-A No. 5-304408
Patent Document 2: JP-A No. 04-200047
Patent Document 3: JP-A No. 61-281724
Patent Document 4: JP-A No. 2002-314450

DISCLOSURE OF THE INVENTION

Problems to be Solved by the Invention

However, the VHF band and the UHF band are considerably spaced from each other, and antennas on radio units find it is difficult for the potential of the characteristics of antennas on radio units to be realized simultaneously.

Of the prior art described above, the antenna device disclosed in Patent Document 1 can be used at two frequencies by combining an extensible and contractible external antenna and a built-in antenna, and can provide a good gain for transmitting and receiving radio waves. However, if the antenna device is to be compatible with frequencies in the VHF band and frequencies in the UHF band, then it is difficult for the potential of the characteristics of antennas on radio units to be realized simultaneously.

The length of an antenna plays an important role among the antenna characteristics. According to the arrangements disclosed in Patent Document 2 and Patent Document 3, it is expected that it is difficult to greatly change the lengths of the two pairs of antennas and also difficult to receive various broadcast waves.

The arrangement disclosed in Patent Document 3 is used for diversity reception, and it is expected that receiving various broadcast waves will be difficult.

The present invention has been made in view of the problems of the prior art described above. In order to eliminate the conventional drawbacks described above, the present invention provides an antenna device for use with a portable terminal, which is capable of operating in a wide frequency band by using an external antenna (a whip antenna or a helical antenna) that can be stored at high frequencies and by combining the external antenna and a built-in antenna at low frequencies.

It is also an object of the present invention to provide a radio unit which achieves better antenna characteristics when earphones are used.

Means for Solving the Problems

An antenna device according to the present invention comprises a plurality of antennas corresponding to different frequencies, respectively, and switching means for switching between the antennas depending on a frequency.

According to the present invention, an antenna device for use with a cellular phone for communicating with a radio base station, comprises:

a first antenna extensible from a housing of the cellular phone;

a second antenna stored in the housing of the cellular phone; and a frequency filter;

wherein only the second antenna is connected to a power feeder with the frequency filter interposed therebetween.

The first antenna may be connected to the power feeder without the frequency filter interposed therebetween.

According to the present invention, an antenna device for use with a cellular phone for communicating with a radio base station, comprises:

a first antenna storable in a housing of the cellular phone;

a second antenna stored in the housing of the cellular phone; and a third antenna mounted on a distal end of the first antenna and electrically insulated from the first antenna;

wherein only the second antenna is connected to a power feeder with a frequency filter interposed therebetween.

The first antenna or the third antenna may be connected to the power feeder without the frequency filter interposed therebetween.

The third antenna may comprise a helical antenna.

The second antenna may comprise a coiled antenna.

The coiled antenna may have a space for storing the first antenna therein.

The second antenna may comprise a meander-line antenna.

The meander-line antenna may have a space for storing the first antenna therein.

The second antenna and the power feeder may be mounted on one substrate.

The second antenna may comprise a meander-line antenna having a hollow semicylindrical shape or an inverted U-shaped cross section to provide a space for storing the first antenna therein, the meander-line antenna being fixed along a surface of a board and positioned to accommodate the first antenna therein.

The second antenna may be of a slender shape having a hollow semicylindrical or inverted U-shaped cross section perpendicular to a longitudinal direction thereof, with an open side of the hollow semicylindrical or U-shaped antenna being fixed to a board, providing a space for storing the first antenna therein.

The first antenna may comprise a whip antenna and is connected to the power feeder when extended.

The antenna device may operate as an antenna having two resonant states by having a state in which the first antenna functions alone and a state in which the first antenna and the second antenna function when connected to each other through the frequency filter.

The first antenna may function alone at frequencies in a UHF band or higher, and the first antenna and the second antenna may function at frequencies in a VHF band or lower when connected to each other through the frequency filter.

The antenna device may operate as an antenna having two resonant states by having a state in which the third antenna functions alone and a state in which the third antenna and the second antenna function when the first antenna is stored.

The third antenna may function alone at frequencies in the UHF band or higher, and the second antenna and the third antenna function at frequencies in the VHF band or lower.

The frequency filter may function to have a sufficiently high impedance value at frequencies in a UHF band and a sufficiently low impedance value at frequencies in a VHF band.

A cellular phone according to the present invention has any one of the antenna devices described above. According to the present invention, a radio unit for receiving a plurality of broadcast waves, comprises:

an antenna for receiving TV broadcast waves including an UHF band and a VHF band and FM broadcast waves;

an earphone connector;

a TV/FM receiver for demodulating received TV broadcast waves including the UHF band and the VHF band and received FM broadcast waves; and a selector switch for selectively connecting either of the lines to antenna and the earphone connector to the TV/FM receiver.

According to another aspect of the present invention, a radio unit for receiving a plurality of broadcast waves, comprises:

an antenna for sending and receiving radio waves in a frequency band used by a cellular phone and receiving TV broadcast waves including an UHF band and a VHF band and FM broadcast waves;

an earphone connector;

a TV/FM receiver for demodulating received TV broadcast waves including the UHF band and the VHF band and received FM broadcast waves;

a frequency distributor for dividing radio waves received by the antenna into radio waves in the frequency band used by the cellular phone and TV broadcast waves and FM broadcast waves; and a selector switch for selectively connecting either of the lines to which TV broadcast waves and FM broadcast waves divided by the frequency distributor are output and the earphone connector to the TV/FM receiver.

The radio unit may further comprise:

an earphone detector for detecting the state in which the earphones are connected with respect to the earphone connector and controlling the selector switch to connect the earphone connector and the TV/FM receiver to each other when the TV/FM receiver is in a state for receiving VHF broadcasts or FM broadcasts.

The radio unit may further comprise:

an impedance switcher connected between the selector switch and the TV/FM receiver, the impedance switcher being switchable between a first impedance for optimizing reception of FM broadcast waves and TV broadcasts in the VHF band and a second impedance for optimizing reception of TV broadcasts in the UHF band;

wherein the earphone detector controls the impedance switcher to switch to the first impedance when the earphones are connected to the earphone connector and the TV/FM receiver receives TV broadcasts in the VHF band or FM broadcast waves.

According to still another aspect of the present invention, a radio unit for receiving broadcast waves, comprises:

any one of the antenna devices described above, for sending and receiving radio waves in a frequency band used by a cellular phone and receiving TV broadcast waves including an UHF band and a VHF band and FM broadcast waves;

an earphone connector;

a TV/FM receiver for demodulating received TV broadcast waves including the UHF band and the VHF band and received FM broadcast waves;

a frequency distributor for dividing radio waves received by the antenna device into radio waves in the frequency band used by the cellular phone and TV broadcast waves and FM broadcast waves; and a switcher for selectively connecting either of the output terminals for outputting TV broadcast waves and FM broadcast waves divided by the frequency distributor and for connecting the earphone connector to the TV/FM receiver.

According to yet another aspect of the present invention, a radio unit for receiving broadcast waves, comprises:

an antenna device for sending and receiving radio waves in a frequency band used by a cellular phone and receiving TV broadcast waves including an UHF band and a VHF band and FM broadcast waves;

an earphone connector;

a receiver for receiving broadcast waves including at least one UHF band and one VHF band which have been received;

a frequency distributor for dividing radio waves received by the antenna device into radio waves in the frequency band used by the cellular phone and broadcast waves; and a switcher for selectively connecting either of the output terminals for outputting broadcast waves divided by the frequency distributor and for connecting the earphone connector to the receiver.

According to yet still another aspect of the present invention, a radio unit for receiving broadcast waves, comprises:

any one of the antenna devices described above, for sending and receiving radio waves in a frequency band used by a cellular phone and for receiving TV broadcast waves including an UHF band and a VHF band and FM broadcast waves;

an earphone connector;

a receiver for receiving broadcast waves including at least one UHF band and one VHF band which have been received;

a frequency distributor for dividing radio waves received by the antenna device into radio waves in the frequency band used by the cellular phone and broadcast waves; and a switcher for selectively connecting either one of an output end for outputting broadcast waves divided by the frequency distributor and for connecting the earphone connector to the receiver.

Earphones operable as an antenna can be connected to the earphone connector.

According to the present invention, a radio unit for communicating with a radio base station, comprises:

a first antenna mounted on a housing of the radio unit, for receiving TV broadcast waves;

a second antenna stored in the housing of the cellular phone, for receiving TV broadcast waves;

a power feeder connected directly to the first antenna and connected to the second antenna through the frequency filter;

a frequency distributor connected to the power feeder, for dividing radio waves received by the first antenna and the second antenna into radio waves in a frequency band used by a cellular phone and TV broadcast waves;

a receiver for receiving TV broadcast waves;

a frequency filter for passing a VHF band therethrough;

an earphone connector;

an earphone detector for detecting the state in which the earphones are connected with respect to the earphone connector; and a switcher for connecting the earphone connector to the receiver if the earphone detector detects when earphones are connected to the earphone connector while the receiver is receiving broadcast waves in the VHF band.

According to another aspect of the present invention, a radio unit for communicating with a radio base station, comprises:

a first antenna mounted on a housing of the radio unit, for receiving TV broadcast waves;

a second antenna stored in the housing of the cellular phone, for receiving TV broadcast waves;

a power feeder connected directly to the first antenna and connected to the second antenna through the frequency filter;

a frequency distributor connected to the power feeder, for dividing radio waves received by the first antenna and the second antenna into radio waves in a frequency band used by a cellular phone and TV broadcast waves;

a receiver for receiving TV broadcast waves;

a frequency filter for passing a VHF band therethrough;

an earphone connector;

an earphone detector for detecting the state in which the earphones are connected with respect to the earphone connector; and a switcher for connecting an output terminal of the frequency distributor for outputting TV broadcast waves to the receiver while the receiver is receiving broadcast waves in a UHF band.

According to still another aspect of the present invention, a radio unit for communicating with a radio base station, comprises:

a first antenna mounted on a housing of the radio unit, for receiving TV broadcast waves;

a second antenna stored in the housing of the cellular phone, for receiving TV broadcast waves;

a power feeder connected directly to the first antenna and connected to the second antenna through the frequency filter;

a frequency distributor connected to the power feeder, for dividing radio waves received by the first antenna and the second antenna into radio waves in a frequency band used by a cellular phone and TV broadcast waves;

a receiver for receiving TV broadcast waves;

a frequency filter for passing a VHF band therethrough;

an earphone connector;

an earphone detector for detecting the state in which the earphones are connected with respect to the earphone connector; and a switcher for connecting an output terminal of the frequency distributor for outputting TV broadcast waves to the receiver if the earphone detector detects when earphones are not connected to the earphone connector while the receiver is receiving broadcast waves in the VHF band.

According to yet another aspect of the present invention, a radio unit for communicating with a radio base station, comprises:

a first antenna mounted on a housing of the radio unit, for receiving TV broadcast waves;

a second antenna stored in the housing of the cellular phone, for receiving TV broadcast waves;

a power feeder connected directly to the first antenna and connected to the second antenna through the frequency filter;

a frequency distributor connected to the power feeder, for dividing radio waves received by the first antenna and the second antenna into radio waves in a frequency band used by a cellular phone and TV broadcast waves;

a receiver for receiving TV broadcast waves;

a frequency filter for passing a VHF band therethrough;

an earphone connector;

an earphone detector for detecting the state in which the earphones are connected with respect to the earphone connector; and a switcher for connecting the earphone connector to said receiver if said earphone detector detects when earphones are connected to said earphone connector while the receiver is receiving broadcast waves in the VHF band, for connecting an output terminal of the frequency distributor for outputting TV broadcast waves to the receiver while the receiver is receiving broadcast waves in a UHF band, and connecting the power feeder to the receiver if the earphone detector detects that earphones are not connected to the earphone connector while the receiver is receiving broadcast waves in the VHF band.

Any one of the radio units described above may further comprise:

a third antenna mounted on a distal end of the first antenna and electrically insulated from the first antenna.

The first antenna may comprise a whip antenna and is connected to the power feeder when extended.

The radio unit may operate as an antenna having two resonant states by having a state in which the first antenna functions alone and a state in which the first antenna and the second antenna function when connected to each other through the frequency filter.

The first antenna may function alone at frequencies in a UHF band or higher, and the first antenna and the second antenna may function at frequencies in a VHF band or lower when connected to each other through the frequency filter.

The second antenna may comprise a coiled antenna.

The second antenna may comprise a meander-line antenna.

The third antenna may comprise a helical antenna.

The radio unit may operate as an antenna having two resonant states by having a state in which the third antenna functions alone and a state in which the third antenna and the second antenna function when the first antenna is stored.

The third antenna may function alone at frequencies in a UHF band or higher, and the second antenna and the third antenna may function at frequencies in a VHF band or lower.

ADVANTAGES OF THE INVENTION

The antenna device is capable of receiving radio waves readily by having a plurality of antennas corresponding to different frequencies, respectively, and switching means for switching between the antennas depending on a frequency.

DESCRIPTION OF REFERENCE CHARACTERS

Figure 1:
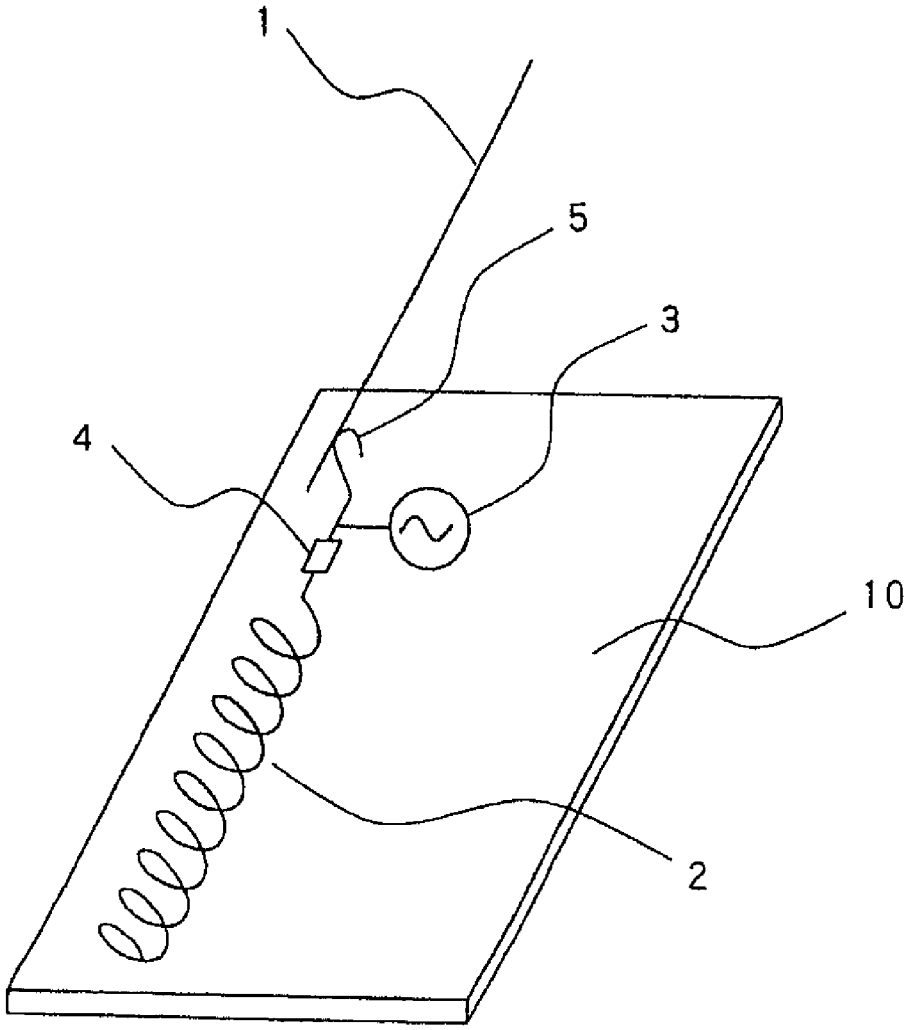
[FIG. 1] is a perspective view of an arrangement according to a first embodiment of the present invention.

1 whip antenna
2 coiled antenna
3 power feeder
4 frequency filter
5 contact member
6 helical antenna
7 meander-line antenna
8 meandering antenna
10 device board
100, 200, 300, 400, 500 cellular phone
101, 301, 401 antenna for cellular phone
102, 302, 402 FM/TV antenna
103, 203, 303, 403, 503 earphone with built-in antenna for VHF band
104, 204, 304, 404, 504 selector switch
105, 205, 305, 405, 505 TV/FM receiver
106, 206, 306, 406, 506 cellular phone radio unit
107, 207, 307, 407, 507 earphone connector
201, 508 frequency distributor
408 earphone detector
509 frequency filter
510 second antenna
S301, S401 detected signal
S302, S402, S403 switching signal

BEST MODE FOR CARRYING OUT THE INVENTION

The best mode for carrying out the invention will be described below with reference to the drawings.

Embodiment 1

FIG. 1 is a perspective view of an arrangement according to a first embodiment of the present invention.

The present embodiment comprises device board 10 of a cellular phone, contact member 5, power feeder 3, whip antenna 1, frequency filter 4, and built-in coiled antenna 2.

Whip antenna 1 is electrically connected to power feeder 3 through contact member 5. Frequency filter 4 is mounted on device board 10, and coiled antenna 2 is electrically connected to power feeder 3 through frequency filter 4.

According to the present embodiment, whip antenna 1 is extended and used as an antenna for high frequencies in a UHF band (300 MHz through 3 GHz) or higher. Frequency filter 4 serves to pass a VHF band and is set to a sufficiently high impedance value for frequencies in the UHF band or higher, so that built-in coiled antenna 2 will not become excited. For high frequencies in the UHF band or higher, therefore, only whip antenna 1 operates as an antenna.

Frequency filter 4 has a small impedance for frequencies in the VHF band (30 through 300 MHz) or lower. At frequencies in the VHF band or lower, therefore, whip antenna 1 and built-in coiled antenna 2 which are connected to each other operate as an antenna.

With the above arrangement, whip antenna 1 receives frequencies in the UHF band or higher, and whip antenna 1 and built-in coiled antenna 2 which operate as an antenna having two resonant states receives frequencies in the VHF band or lower. The antenna in this embodiment is capable of operating in a wide frequency band, from the UHF band to the VHF band.

Frequency filter 4 may comprise an inductance or a low-pass filter depending on the frequency band in use.

In the present embodiment arranged as described above, the types of antennas that are used for reception depending on the reception frequencies are shown in Table 1.

Table 1

UHF whip antenna 1
VHF whip antenna 1
+coiled antenna 2

Embodiment 2

Figure 2:
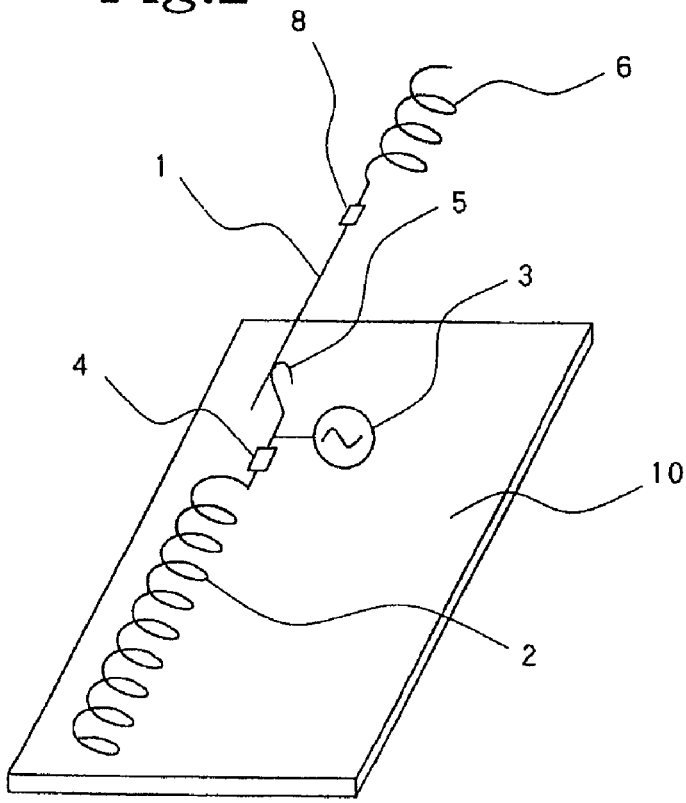
[FIG. 2] is a perspective view of an arrangement according to a second embodiment of the present invention.
Figure 3:
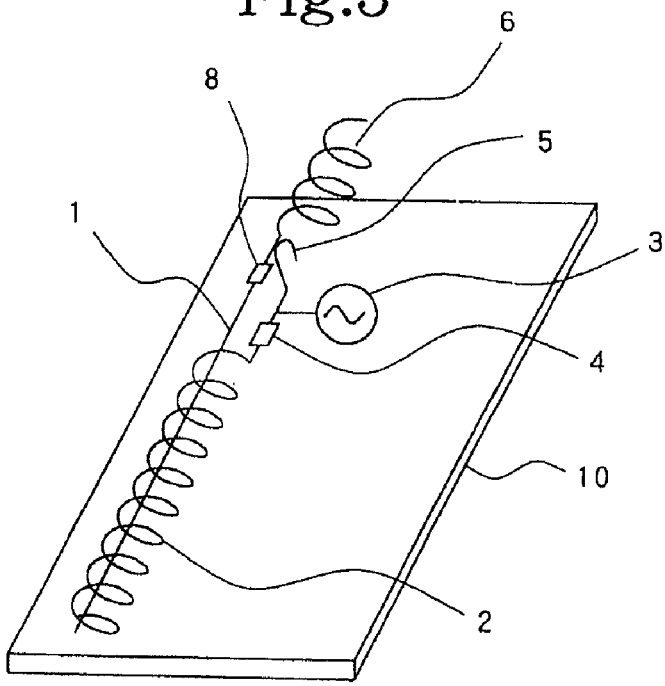
[FIG. 3] is a perspective view of the arrangement according to the second embodiment of the present invention.

FIGS. 2 and 3 are perspective views showing an essential arrangement according to a second embodiment of the present invention.

The present embodiment differs from the first embodiment in that helical antenna 6 is mounted on the distal end of whip antenna 1, in addition to the arrangement according to the first embodiment shown in FIG. 1. Helical antenna 6 is mounted on the distal end of whip antenna 1 by connector 8 including an insulator, and is electrically insulated from whip antenna 1.

In FIG. 2, whip antenna 1 is shown as being extended. In this state, as with the first embodiment shown in FIG. 1, the impedance value of frequency filter 4 is appropriately selected, so that only whip antenna 1 operates as an antenna for frequencies in the UHF band or higher, and whip antenna 1 and built-in coiled antenna 2 are connected to each other and operate as an antenna for frequencies in the VHF band or lower. Thus, the arrangement operates as an antenna having two resonant states.

When whip antenna 1 is stored as shown in FIG. 3, helical antenna 6 mounted on the distal end of whip antenna 1 is electrically connected to power feeder 3 through contact member 5, so that only helical antenna 6 operates as an antenna for frequencies in the UHF band or higher, and helical antenna 6 and built-in coiled antenna 2 are excited and operate as an antenna having two resonant states for frequencies in the VHF band or lower.

With the above arrangement, when whip antenna 1 is extended, whip antenna 1 and coiled antenna 2 are combined with each other to provide the same characteristics as those of the first embodiment. When whip antenna 1 is stored, characteristics are provided by a combination of helical antenna 6 and coiled antenna 2. Therefore, a desired frequency band is obtained when whip antenna 1 is both extended and stored.

Specific structural examples of whip antenna 1 and helical antenna 6 according to the second embodiment will be described below with reference to FIGS. 4 through 8.

Figure 4:
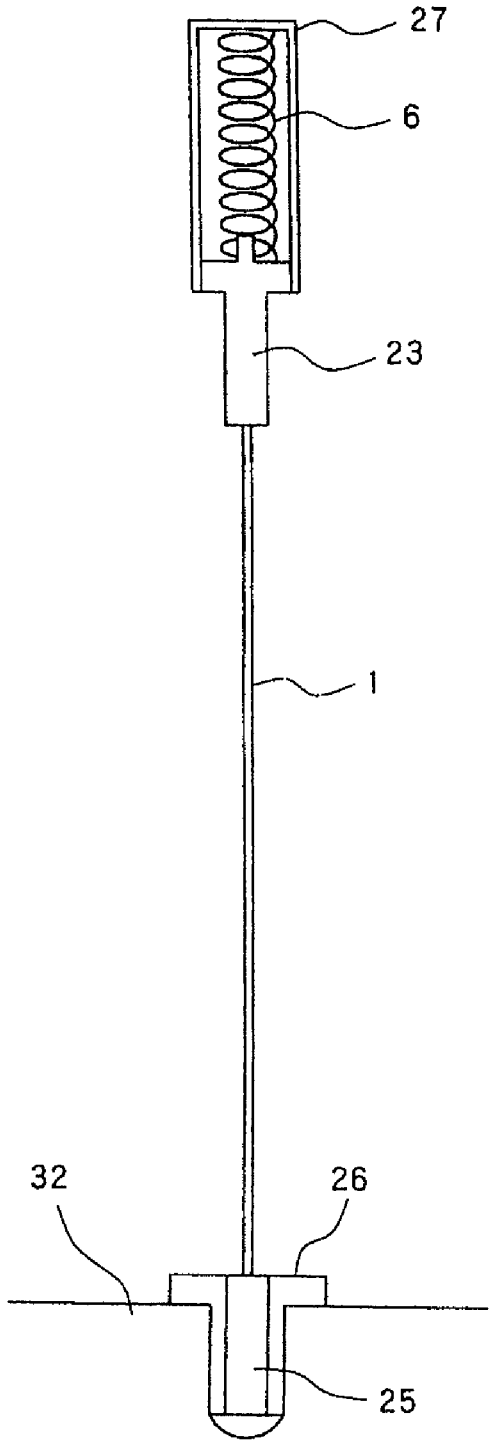
[FIG. 4] is a cross-sectional view showing a structure of an antenna comprising a combination of whip antenna 1 and helical antenna 6.
Figure 5:
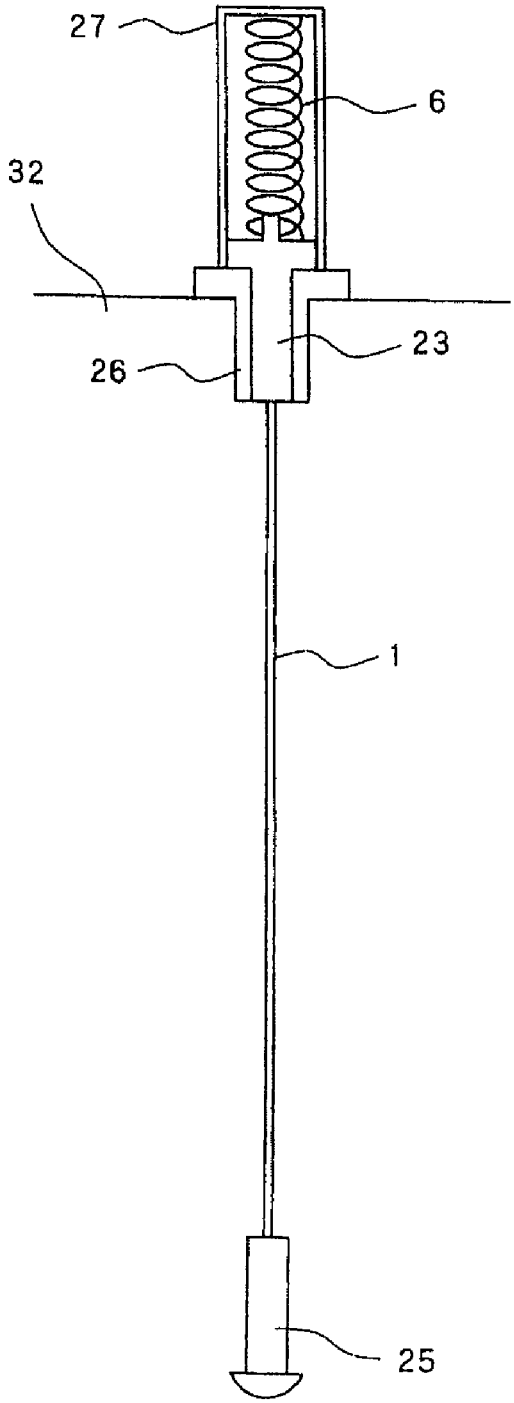
[FIG. 5] is a cross-sectional view showing a structure of an antenna comprising a combination of whip antenna 1 and helical antenna 6.

FIGS. 4 and 5 are cross-sectional views showing structures of antennas comprising combinations of whip antenna 1 and helical antenna 6.

Figure 6:
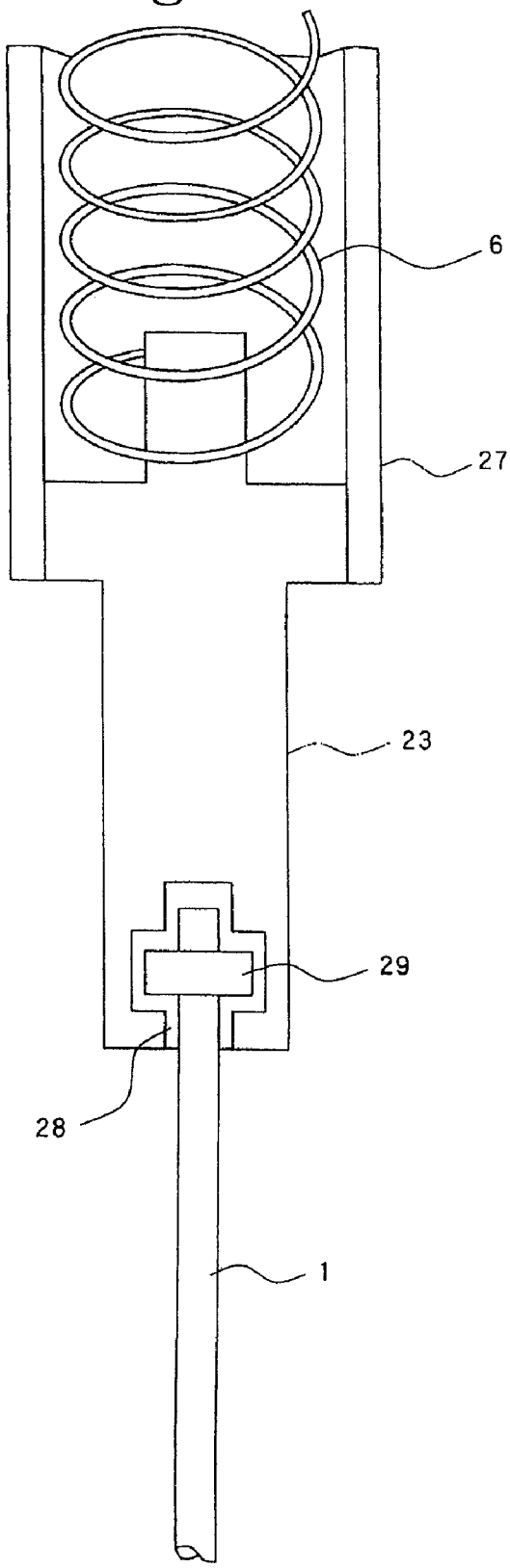
[FIG. 6] is an enlarged fragmentary cross-sectional view showing a junction structure of whip antenna 1 and helical antenna 6 shown in FIGS. 4 and 5.

FIG. 6 is an enlarged fragmentary cross-sectional view showing a junction structure of whip antenna 1 and helical antenna 6 shown in FIGS. 4 and 5, and FIGS. 7 and 8 are cross-sectional views showing an internal arrangement of portable terminal 31 equipped with whip antenna 1 and helical antenna 6.

As shown in FIGS. 4 and 5, helical antenna 6 is covered with cover 27. Whip antenna 1 comprises an antenna which is mounted in housing 20 and can be extended and stored, the antenna having an electrical length of $\lambda/2$ (½ wavelength).

Whip antenna 1 and helical antenna 6 are electrically connected to each other by helical antenna power feeder 23 mounted on the end of helical antenna 6. As shown in FIG. 6, the junction structure has retainer 29 mounted on the end of whip antenna 1 and housed in a gap defined in helical antenna power feeder 23, thereby connecting whip antenna 1 and helical antenna 6 to each other. The end of whip antenna 1 and retainer 29 are surrounded by insulator 28, which corresponds to connector 9 shown in FIGS. 2 and 3, electrically insulating whip antenna 1 and helical antenna 6 from each other.

Whip antenna 1 and helical antenna 6 are supported by antenna holder 26 mounted on housing 32 of the portable terminal. When whip antenna 1 projects from housing 32 as shown in FIG. 4, whip antenna power feeder 25 that is electrically connected to whip antenna 1 is brought into contact with antenna holder 26, electrically connecting whip antenna 1 and antenna holder 26 to each other. When whip antenna 1 is stored in housing 32 as shown in FIG. 5, helical antenna power feeder 23 that is electrically connected to helical antenna 6 is brought into contact with antenna holder 26, electrically connecting helical antenna 6 and antenna holder 26 to each other.

Figure 7:
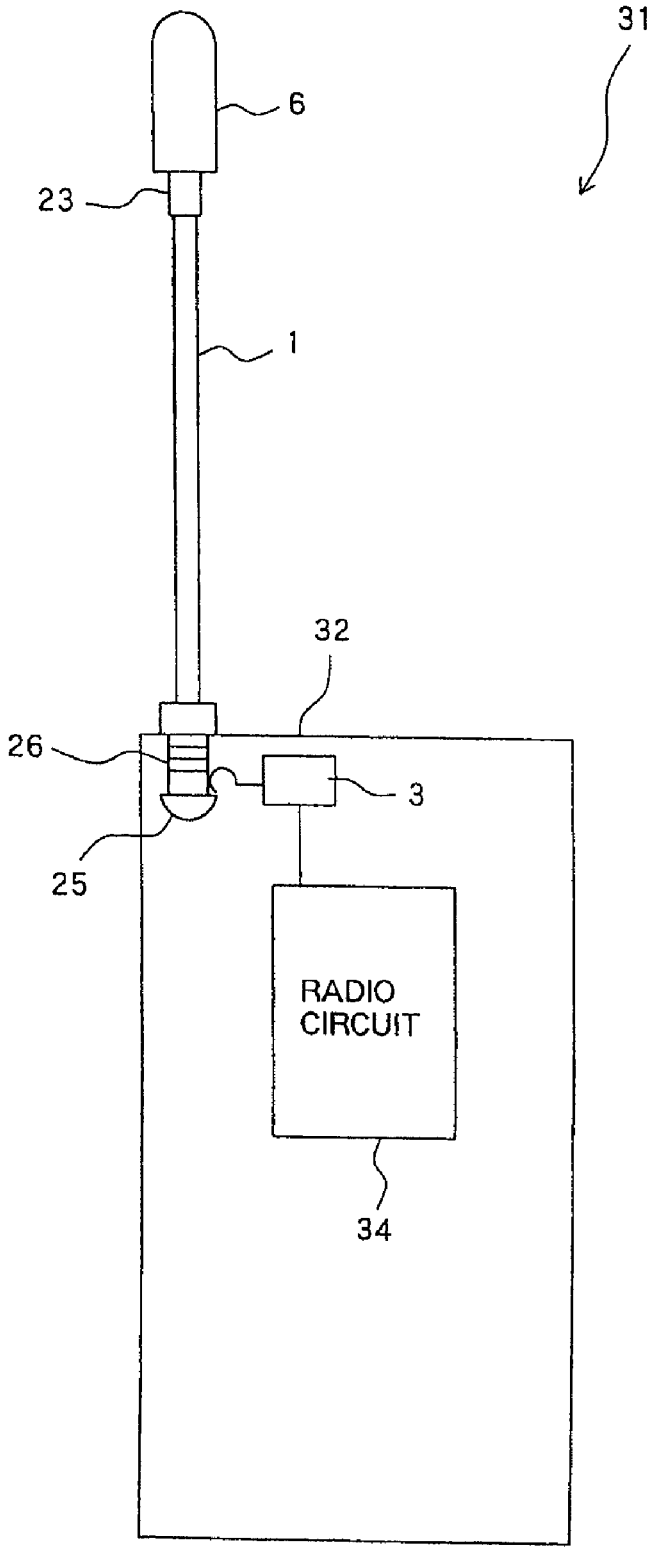
[FIG. 7] is a cross-sectional view showing an internal arrangement of portable terminal 31 equipped with whip antenna 1 and helical antenna 6.
Figure 8:
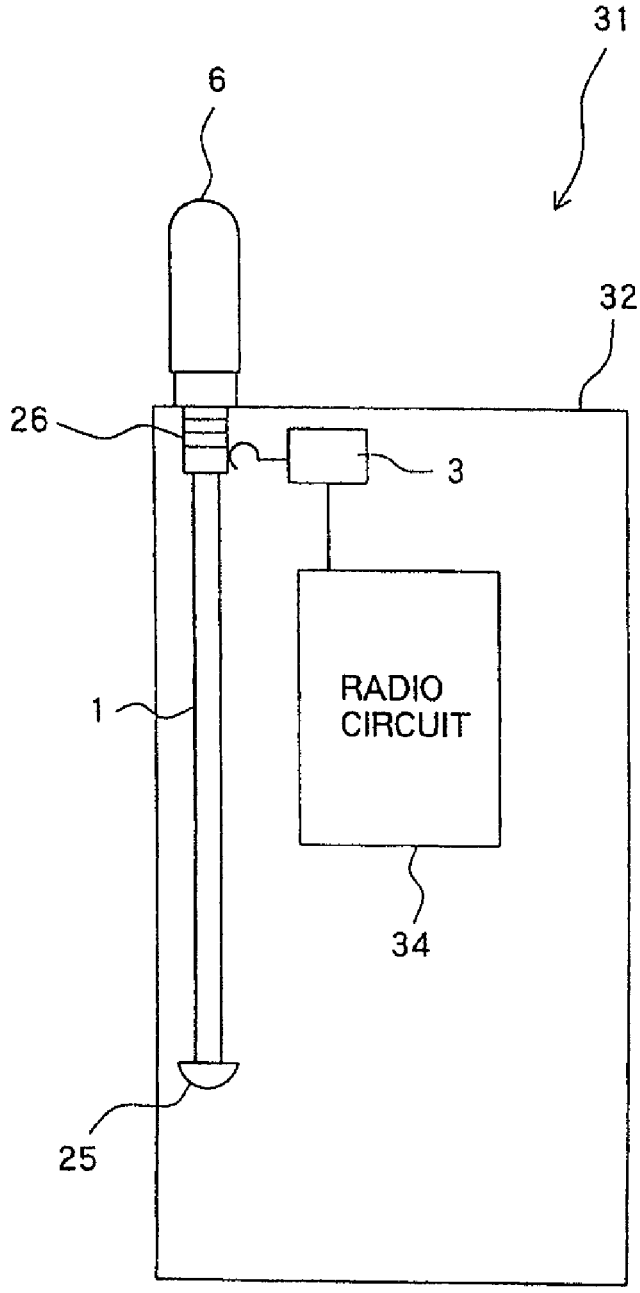
[FIG. 8] is a cross-sectional view showing an internal arrangement of portable terminal 31 equipped with whip antenna 1 and helical antenna 6.

As shown in FIGS. 7 and 8, whip antenna 1 mounted on the upper end of housing 32 of portable terminal 31 is connected to radio circuit 34 through contact member 5 and power feeder 3. Contact member 5 that is connected to power feeder 3 is held in contact with antenna holder 26 shown in FIG. 4 at all times.

Operation of whip antenna 1 and helical antenna 6 will be described below.

As shown in FIGS. 4 and 7, when whip antenna 1 is extended, it is supplied with electric power from whip antenna power feeder 25. As shown in FIGS. 5 and 8, when whip antenna 1 is stored in housing 32, since whip antenna 1 is coupled to helical antenna power feeder 23 through insulator 28, stored whip antenna 1 and helical antenna power feeder 23 are electrically disconnected from each other, and only helical antenna 6 is supplied with electric power from helical antenna power feeder 23. Helical antenna 6 operates as a helical antenna alone having an electrical length of $\lambda/2$ or $\lambda/4$, for example.

According to the first and second embodiments described above, coiled antenna 2 in the form of a hollow cylinder is employed to provide a space for storing whip antenna 1 therein.

Inasmuch as whip antenna 1 disconnected from power feeder 3 is stored in the hollow cylindrical space provided by coiled antenna 2, the space in the device is prevented from increasing.

In the present embodiment arranged as described above, the types of antennas that are used for reception, depending on the reception frequencies when the antenna is extended and when the antenna is stored, are shown in Table 2.

Table 2-1 (when the Antenna is Extended)
UHF whip antenna 1
VHF whip antenna 1
+coiled antenna 2
Table 2-2 (when the Antenna is Stored)
UHF helical antenna 6
VHF helical antenna 6
+coiled antenna 2

Embodiment 3

Figure 9:
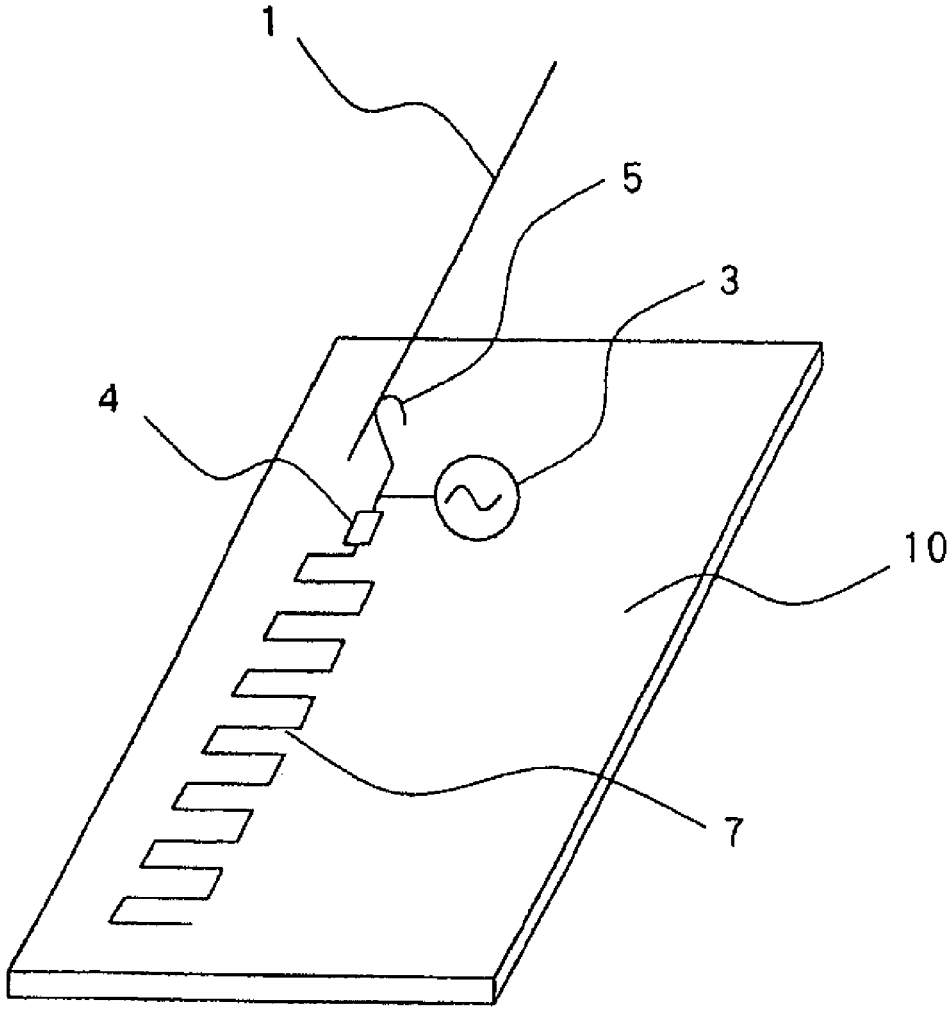
[FIG. 9] is a perspective view of an arrangement according to a third embodiment of the present invention.

FIG. 9 is a perspective view of an arrangement according to a third embodiment of the present invention.

According to the present embodiment, the built-in antenna comprises meander-line antenna 7, instead of coiled antenna 2 used in the first embodiment, mounted on device board 10. Other details of the present embodiment are identical to those of the embodiment shown in FIG. 1.

With the arrangement shown in FIG. 9, the built-in antenna is fixedly mounted as meander-line antenna 7 on the same board as power feeder 3, thereby eliminating the need for increasing the amount of space in the device. The meandering element may comprise a conductor or circuit pattern.

In the present embodiment arranged as described above, the types of antennas that are used for reception depending on the reception frequencies are shown in Table 3.

Table 3
UHF whip antenna 1
VHF whip antenna 1
+meander-line antenna 7

Embodiment 4

Figure 10:
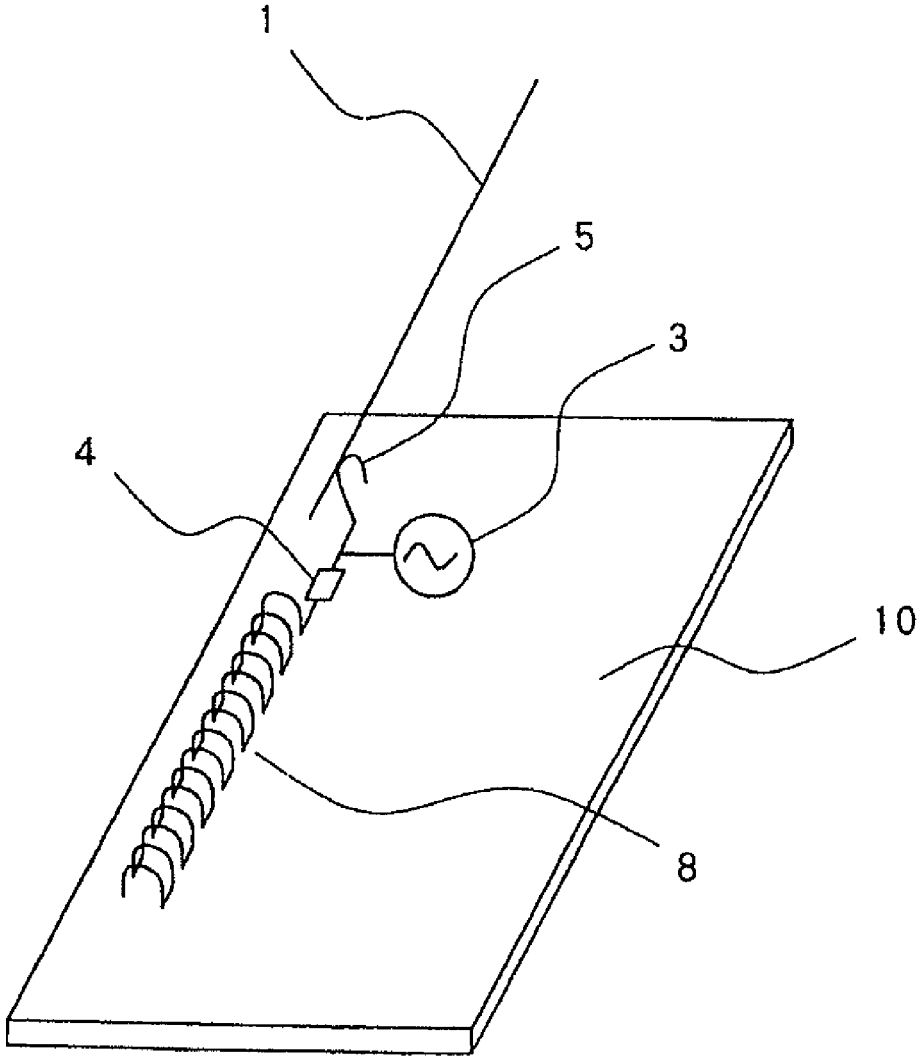
[FIG. 10] is a perspective view of an arrangement according to a fourth embodiment of the present invention.

FIG. 10 is a perspective view of an arrangement according to a fourth embodiment of the present invention.

According to the present embodiment, the built-in antenna comprises meandering antenna 8 having a hollow semicylindrical shape or an inverted U-shaped cross section, instead of coiled antenna 2 used in the first embodiment, mounted on device board 10. Other details of the present embodiment are identical to those of the embodiment shown in FIG. 1.

As shown in FIG. 10, meandering antenna 8 is of a slender shape and has a hollow semicylindrical or inverted U-shaped cross section perpendicular to the longitudinal direction thereof. The open side of the hollow semicylindrical or U-shaped antenna is fixed to the board, providing a space for storing whip antenna 1 therein.

With the arrangement shown in FIG. 10, the built-in antenna is fixedly mounted as meandering antenna 8 having a hollow semicylindrical shape or an inverted U-shaped cross section on the board, thereby effectively utilizing space in the device by storing whip antenna 1 in the provided space.

In the present embodiment arranged as described above, the types of antennas that are used for reception depending on the reception frequencies are shown in Table 4.

Table 4

UHF whip antenna 1

VHF whip antenna 1

+meandering antenna 8

Embodiment 5

Figure 11:
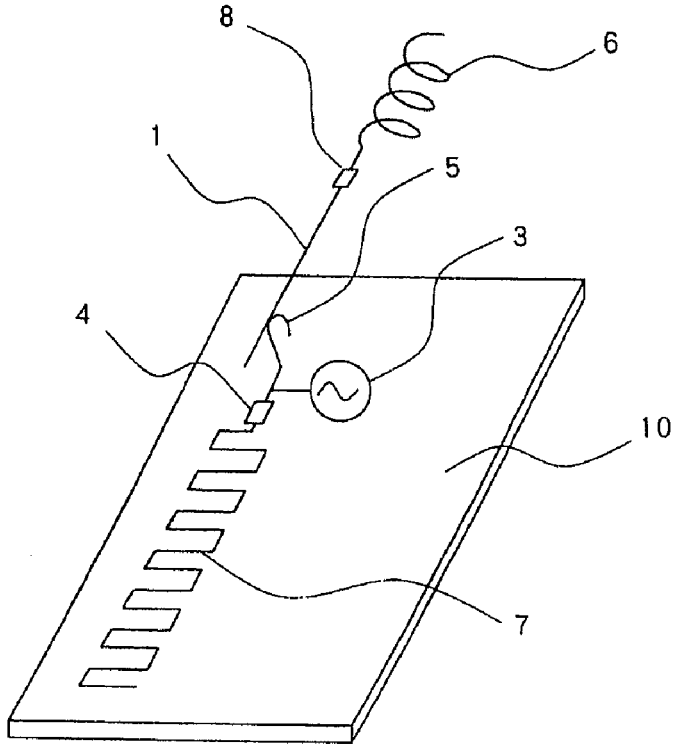
[FIG. 11] is a perspective view of an arrangement according to a fifth embodiment of the present invention.

FIG. 11 is a perspective view of an arrangement according to a fifth embodiment of the present invention.

According to the present embodiment, the built-in antenna comprises meander-line antenna 7, instead of coiled antenna 2 used in the second embodiment, mounted on device board 10. Other details of the present embodiment are identical to those of the embodiment shown in FIG. 2.

With the arrangement shown in FIG. 11, the built-in antenna is fixedly mounted as meander-line antenna 7 on the same board as power feeder 3, thereby eliminating the need for increasing the amount of space in the device from increasing. The meandering element may comprise a conductor or circuit pattern.

Embodiment 6

Figure 12:
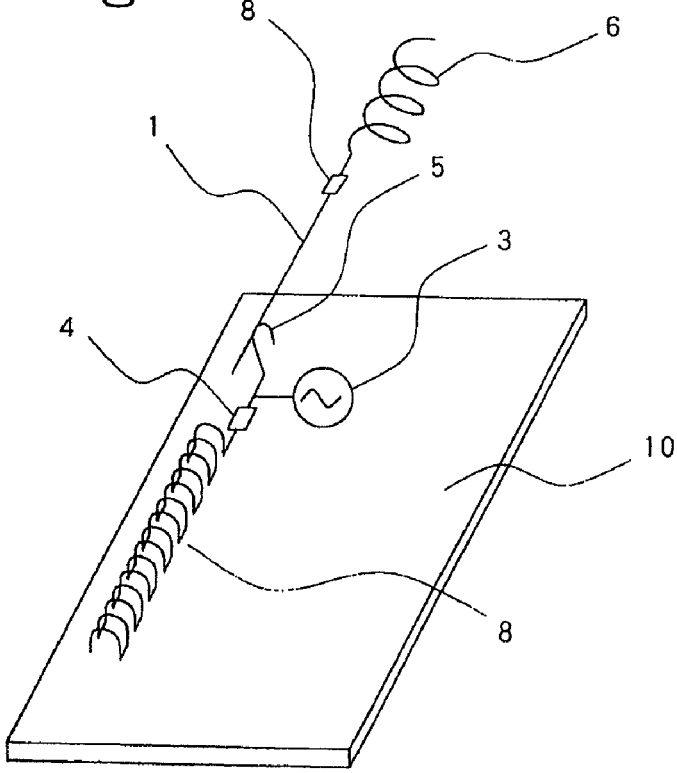
[FIG. 12] is a perspective view of an arrangement according to a sixth embodiment of the present invention.

FIG. 12 is a perspective view of an arrangement according to a sixth embodiment of the present invention.

According to the present embodiment, the built-in antenna comprises meandering antenna 8 having a hollow semicylindrical shape or an inverted U-shaped cross section, instead of coiled antenna 2 used in the second embodiment, mounted on device board 10. Other details of the present embodiment are identical to those of the embodiment shown in FIG. 2.

With the arrangement shown in FIG. 12, the built-in antenna is fixedly mounted as meandering antenna 8 having a hollow semicylindrical shape or an inverted U-shaped cross section on the board, thereby effectively utilizing space in the device by storing whip antenna 1 in the provided space.

As described above, the antenna device for portable terminals according to the present invention can be operated as an antenna having two resonant states covering a mobile station transmission frequency band and a mobile station reception frequency band when whip antenna 1 is extended and when whip antenna 1 is stored, depending on the antenna characteristics, by appropriately setting the resonant frequencies of whip antenna 1, helical antenna 6 mounted on the distal end of whip antenna 1, and the built-in antenna.

Either one of the first through sixth embodiments described above is applied to the portable terminal shown in FIGS. 7 and 8. The present invention covers a portable terminal having the antenna device according to any one of the first through sixth embodiments.

The antenna devices for portable terminals according to the above embodiments are advantageous in that they can be used at two frequencies corresponding to frequencies in the UHF band and the VHF band without impairing efforts to reduce their size, by combining the antenna characteristics of the whip antenna that can be stored, the helical antenna mounted on the distal end of the whip antenna, and the built-in antenna.

Embodiment 7

A seventh embodiment of the present invention will be described below with reference to the drawings.

Figure 13:
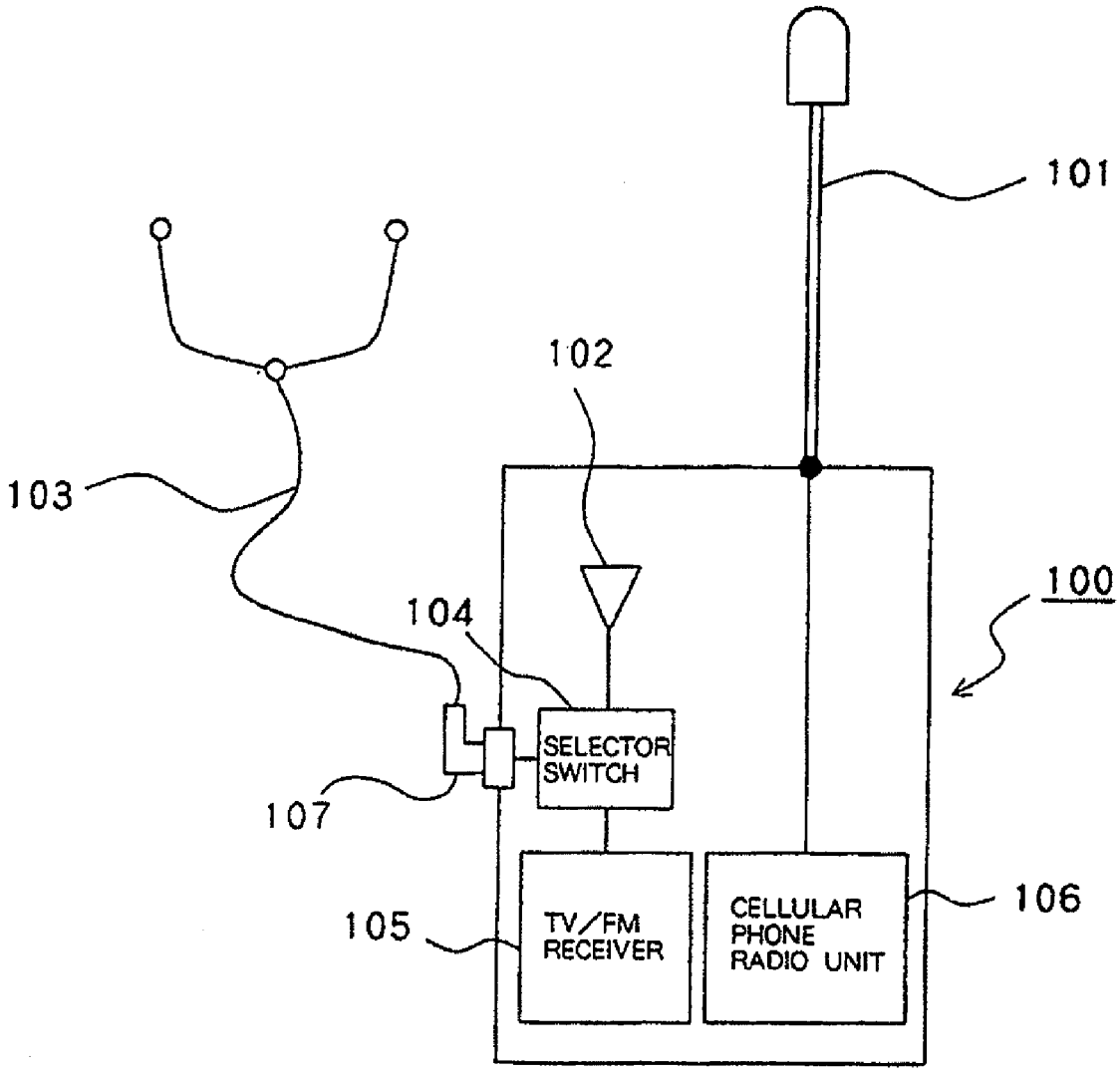
[FIG. 13] is a block diagram showing an essential arrangement according to a seventh embodiment of the present invention.

FIG. 13 is a block diagram showing an essential arrangement of cellular phone 100 according to a seventh embodiment of the present invention.

Cellular phone 100 has a function to receive FM broadcasts and TV broadcasts, in addition to a function to operate as a cellular phone. Cellular phone 100 has cellular phone antenna 101, and also has FM/TV antenna 102, earphone connector 107, selector switch 104 as a switcher, TV/FM receiver 105, and cellular phone radio unit 106 which are disposed in a housing. Cellular phone 100 is premised on the use of earphones 103 with a built-in VHF band antenna which functions as an antenna for the VHF band. FIG. 13 shows that earphones 103 with the built-in VHF band antenna are inserted in earphone connector 107.

Earphones 13 with the built-in VHF band antenna may be of either an arrangement having a built-in antenna for the VHF band or an arrangement having an earphone cable doubling as an antenna for the VHF band.

Cellular phone 100 also has, in addition to the above components, a display unit for displaying TV images and information about the cellular phone, a speaker for outputting speech sound, an input means for selecting modes of operation, and a means for performing the cellular phone function. Since these additional components are of a general nature and can be realized by known technology, they will not be shown and described.

Cellular phone antenna 101 is an antenna for transmitting and receiving radio waves in the frequency band used by the cellular phone. FM/TV antenna 102 is an antenna for receiving FM broadcasts and TV broadcasts in the VHF band and the UHF band. Selector switch 104 is connected to FM/TV antenna 102 and earphone connector 107, and selectively connects either one of lines (output terminals) of FM/TV antenna 102 and earphone connector 107 to TV/FM receiver 105 depending on an input signal applied to the input means. Cellular phone radio unit 106 transmits and receives signals through cellular phone antenna 101 when cellular phone 100 functions as a cellular phone.

Operation of the present embodiment will be described below.

When the user of cellular phone antenna 101 uses it as a cellular phone, it operates only with cellular phone radio unit 106 and cellular phone antenna 101. When the user of cellular phone antenna 101 sees or listens to FM broadcasts, UHF broadcasts of TV, or VHF broadcasts of TV, selector switch 104 switches to a line (output terminal) to be selected depending on the broadcast band for using either FM/TV antenna 102 or earphones 103 with the built-in VHF band antenna. This is because earphones 103 with the built-in VHF band antenna provide better antenna characteristics for lower frequencies in FM broadcasts or the VHF band of TV, and because FM/TV antenna 102 provides better antenna characteristics for higher frequencies in the UHF band of TV. The reasons for this will be described below.

To obtain better antenna characteristics from cellular phones, it is necessary that the cellular phone housing including the antenna have a length of about $\lambda/2$ with respect to the wavelength at a frequency to be received.

Since recent general small-size cellular phones have a housing length of about over 10 cm, the housing length including the antenna is about 20 cm.

Because the frequencies in the UHF band of TV are in the range from 470 to 770 MHz, one wavelength ranges from about 60 to 40 cm, and $\lambda/2$ ranges from about 30 to 20 cm. Therefore, the above housing length is close to $\lambda/2$ of the wavelengths at the frequencies.

Because the frequencies in the FM broadcasts and the VHF band of TV are in the range from 76 to 220 MHz, one wavelength ranges from about 400 to 140 cm, and $\lambda/2$ ranges from about 200 to 70 cm. Therefore, the above housing length is about $\lambda/10$ of the wavelengths at the frequencies, resulting in poorer antenna characteristics.

Earphones used with small-size cellular phones have a length ranging from about 100 to 150 cm, which is nearly $\lambda/2$. Therefore, if earphones are used as an antenna, then they provide better antenna characteristics than FM and TV antennas housed in or mounted on the housing of the small-size cellular phone for FM broadcasts and for TV broadcasts in the VHF band.

Conversely, if earphones are used as an antenna for TV broadcasts in the UHF band, then since the earphones have a length of about $5\lambda$, an opposite-phase current produces many side lobes, resulting in unwanted antenna radiation characteristics.

Cellular phones which are supposed to be mobile around should preferably have broader radiation characteristics free of side lobes for achieving stable reception.

With the arrangement of the present embodiment, it is possible to use an optimum antenna for better reception depending on the wavelength at a frequency used.

TV/FM receiver 105 may be arranged for demodulator UHF broadcasts or VHF broadcasts only.

Selector switch 104 may comprise a mechanical switch. However, it is not limited to a mechanical switch, but may be an electronic switch. Attenuators may be connected to the respective antenna lines for attenuating a signal from an antenna and passing a signal from another antenna without attenuation, for thereby selecting one of the antennas for the signal to be used. Such attenuators may be used as selector switch 104.

Embodiment 8

Figure 14:
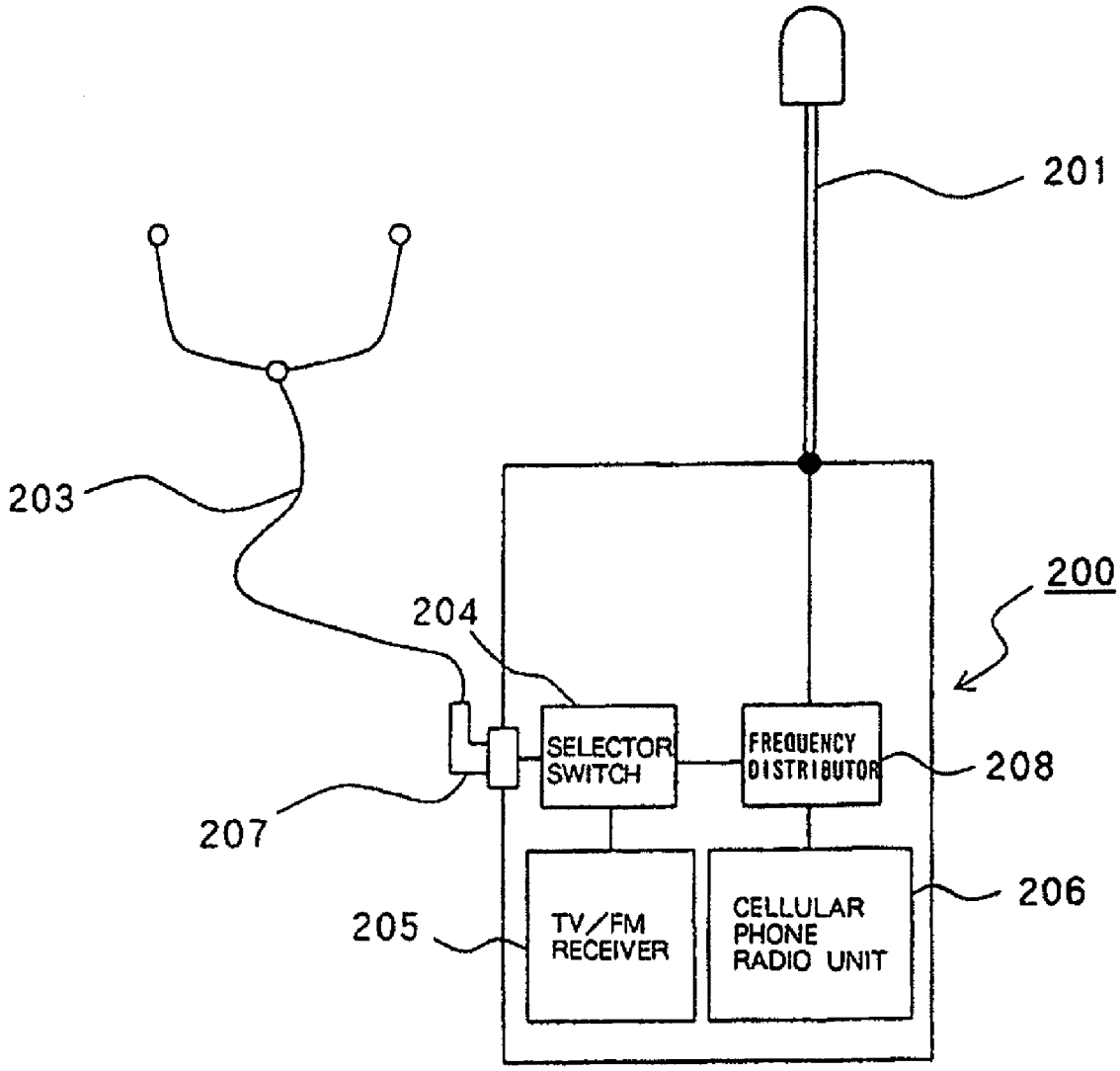
[FIG. 14] is a block diagram showing an essential arrangement according to an eighth embodiment of the present invention.

FIG. 14 is a block diagram showing an essential arrangement according to an eighth embodiment of the present invention.

Cellular phone 200 according to the present embodiment has selector switch 204, TV/FM receiver 205, cellular phone radio unit 206, earphone connector 207, and earphones 203 with a built-in VHF band antenna, which are connected to earphone connector 207 and which are identical to selector switch 104, TV/FM receiver 105, cellular phone radio unit 106, earphone connector 107, and earphones 103 with a built-in VHF band antenna as shown in FIG. 13, and will not be described below.

According to the present embodiment, cellular phone antenna 101 which is used to transmit and receive radio waves in the band used in the cellular phone according to the seventh embodiment, is replaced with cellular phone/TV/FM shared antenna 201 for transmitting and receiving radio waves in the band used in the cellular phone and also for receiving TV broadcasts in the VHF band and the UHF band.

Antenna output signals from cellular phone/TV/FM shared antenna 201 are used in the transmitting and receiving operation of cellular phone radio unit 206 and the receiving operation of the TV/FM receiver. Since cellular phone/TV/FM shared antenna 201 transmits and receives or receives broadcasts at low frequencies (770 MHz or lower) such as FM broadcasts and TV broadcasts, and radio waves at high frequencies (800 MHz or higher) used by the cellular phone, antenna output signals from cellular phone/TV/FM shared antenna 201 are sent to frequency distributor 208, which sends broadcasts at low frequencies such as FM broadcasts and TV broadcasts to selector switch 204 and sends radio waves at high frequencies used by the cellular phone to cellular phone radio unit 206. Therefore, no mutual interference occurs between cellular phone radio unit 206 and TV/FM receiver 206. Other structural and operational details are identical to those of the seventh embodiment shown in FIG. 13.

According to the present embodiment thus arranged, an optimum antenna is used for better reception, and, in addition, there is no need for an antenna for FM broadcasts and TV broadcasts which requires a certain length within the housing. The device is thus structurally simpler and smaller in size.

Embodiment 9

Figure 15:
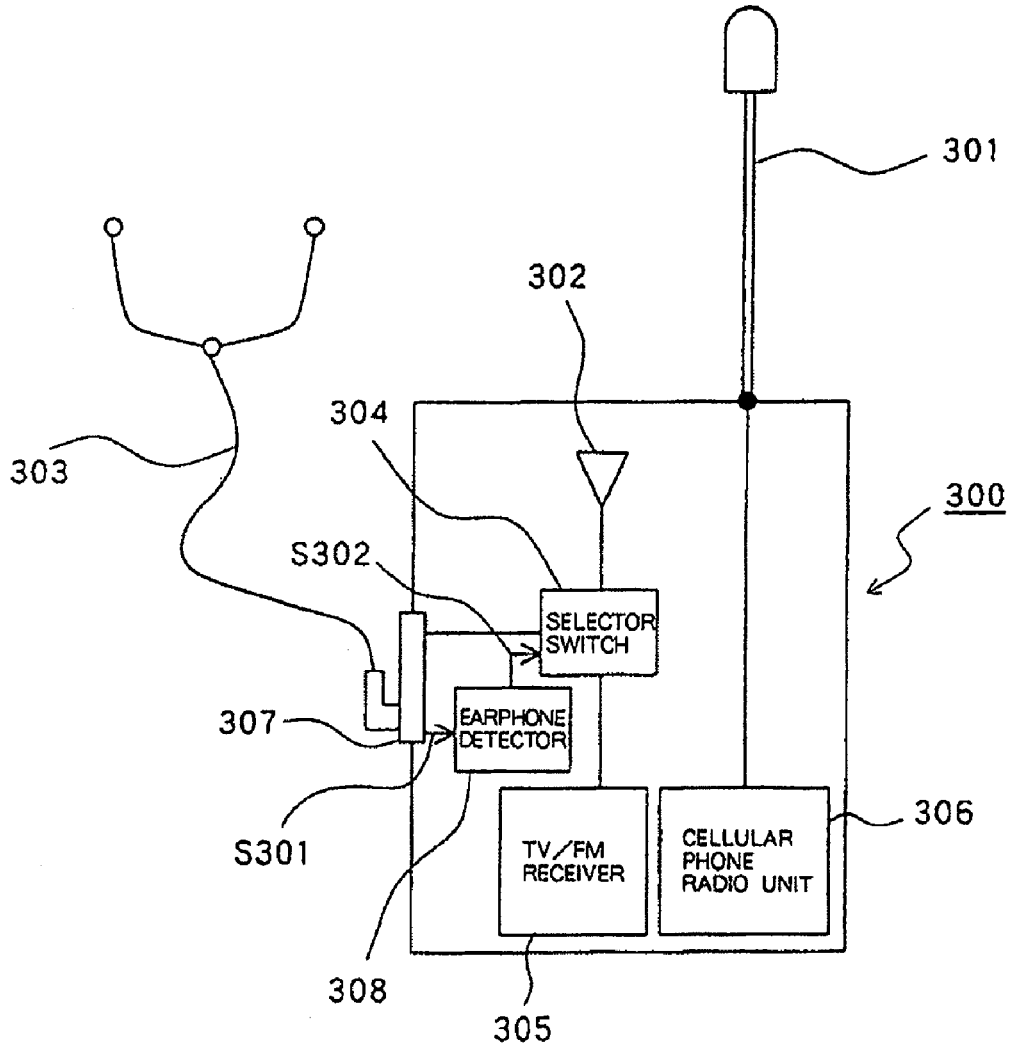
[FIG. 15] is a block diagram showing an essential arrangement according to a ninth embodiment of the present invention.

FIG. 15 is a block diagram showing an essential arrangement according to a ninth embodiment of the present invention.

Cellular phone 300 according to the present embodiment has cellular phone antenna 301, FM/TV antenna 302, selector switch 304, TV/FM receiver 305, cellular phone radio unit 306, and earphones 303 with a built-in VHF band antenna, which are connected to earphone connector 307 and which are identical to cellular phone antenna 101, FM/TV antenna 102, selector switch 104, TV/FM receiver 105, cellular phone radio unit 106, and earphones 103 with a built-in VHF band antenna as shown in FIG. 13, and will not be described below.

The present embodiment has, in addition to the above arrangement, earphone detector 308 for detecting a connected state of earphones 303 with a built-in VHF band antenna with respect to earphone connector 307, and for controlling switching of selector switch 304 depending on the connected state.

Earphone connector 307 in the present embodiment outputs detected signal S301 indicative of whether earphones 403 with a built-in VHF band antenna are connected to earphone connector 307 or not, to earphone detector 308. Earphone detector 308 is also supplied with a signal (not shown) indicative of the present operating state of cellular phone 300. If cellular phone 300 is receiving a VHF broadcast of TV or an FM broadcast and detected signal S301 indicates that earphones 303 with a built-in VHF band antenna are being connected to earphone connector 307, then earphone detector 308 outputs switching signal S302 for switching a line to be selected by selector switch 304 to a line connected to earphone connector 307, to selector switch 304. In response to the switching signal, selector switch 304 selects the line connected to earphone connector 307, allowing the user to see or listen to the broadcast using earphones 303 with a built-in VHF band antenna.

If a signal indicating that cellular phone 300 is receiving a VHF broadcast of TV or an FM broadcast is input to earphone detector 308 while earphones 303 with a built-in VHF band antenna are being connected to earphone connector 307, then earphone detector 308 switches selector switch 304 to earphones 303 with a built-in VHF band antenna. If a signal indicating that cellular phone 300 is receiving a UHF broadcast of TV is input to earphone detector 308 while earphones 303 with a built-in VHF band antenna are being connected to earphone connector 307, then earphone detector 308 does not switch selector switch 304 to earphones 303 with a built-in VHF band antenna, but holds selector switch 304 connected to FM/TV antenna 302.

If earphones 303 with a built-in VHF band antenna are not connected to earphone connector 307, then earphone detector 308 does not switch selector switch 304 to earphones 303 with a built-in VHF band antenna, but holds selector switch 304 connected to FM/TV antenna 302. In this case, therefore, FM/TV antenna 302 receives all broadcasts and outputs them to TV/FM receiver 305.

According to the present embodiment thus arranged, an optimum antenna is used for better reception, and, in addition, since the operation is automatically carried out, the user can use the antenna device conveniently.

In the present embodiment arranged as described above, the types of antennas that are used for reception depending on the state of cellular phone 300 are shown in Table 5.

Table 5

With earphones Without earphones

UHF FM/TV antenna 302 FM/TV antenna 302

VHF/FM earphones 303 with built-in antenna for VHF band earphones 303 with built-in antenna for VHF band Embodiment 10

Figure 16:
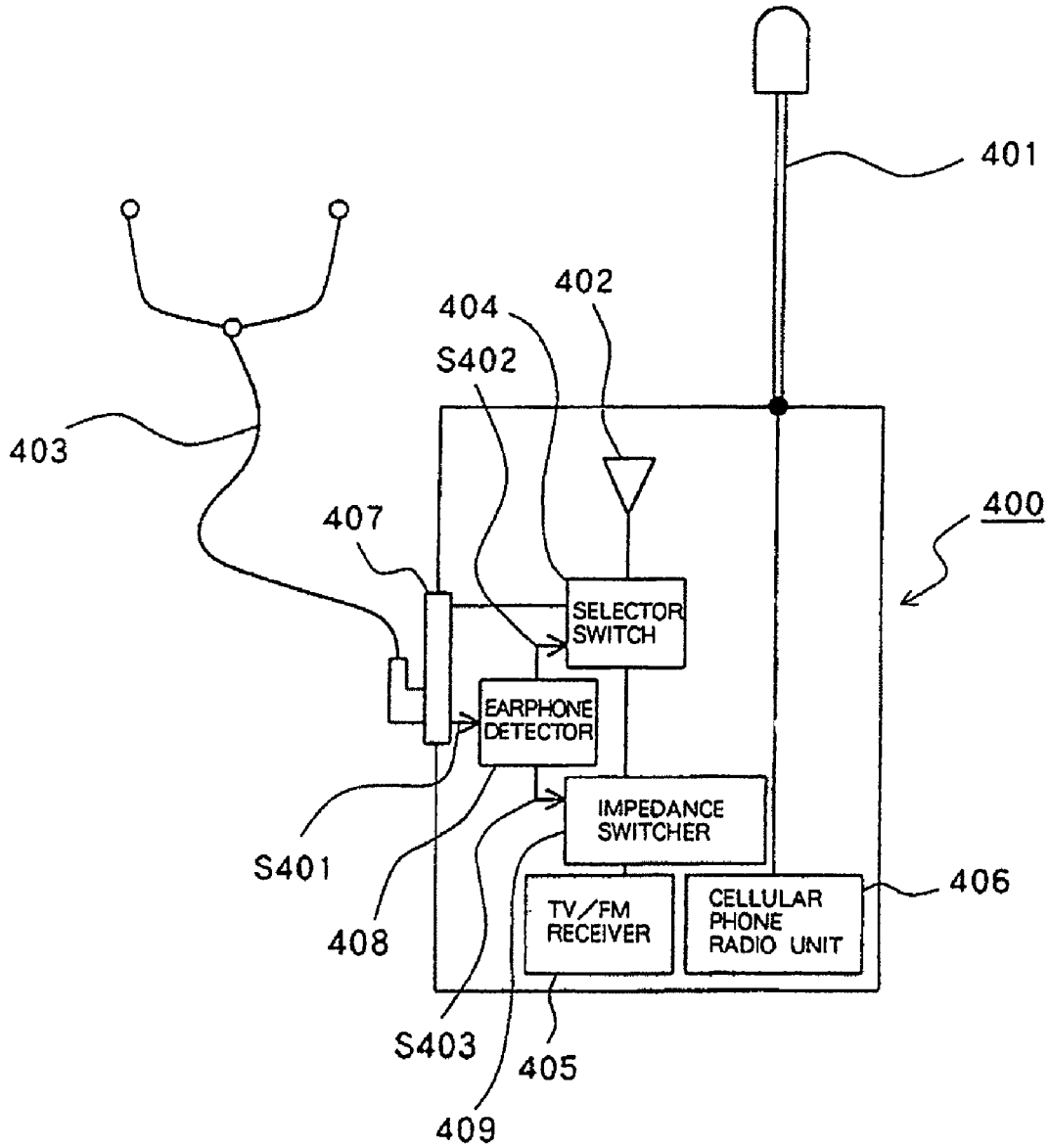
[FIG. 16] is a block diagram showing an essential arrangement according to a tenth embodiment of the present invention.

FIG. 16 is a block diagram showing an essential arrangement according to a tenth embodiment of the present invention.

Cellular phone 400 according to the present embodiment has cellular phone antenna 401, FM/TV antenna 402, selector switch 404, TV/FM receiver 405, cellular phone radio unit 406, earphone connector 407, and earphones 403 with a built-in VHF band antenna, which are connected to earphone connector 407 and which are identical to cellular phone antenna 301, FM/TV antenna 302, selector switch 304, TV/FM receiver 305, cellular phone radio unit 306, earphone connector 307, and earphones 303 with a built-in VHF band antenna as shown in FIG. 15, and will not be described below.

In the present embodiment, impedance switcher 409 is connected between selector switch 404 and TV/FM receiver 405. Impedance switcher 409 is provided to optimize reception states when FM/TV antenna 404 receives radio waves and when earphones 403 with a built-in VHF band antenna receive radio waves. Impedance switcher 409 has impedance that is changeable.

Earphone connector 407 in the present embodiment outputs detected signal S401, indicative of whether earphones 403 with a built-in VHF band antenna are connected to earphone connector 407 or not, to earphone detector 408. Earphone detector 308 outputs switching signal S402, depending on detected signal S401 and a signal indicative of the present operating state of cellular phone 400, to selector switch 404. Operation up to this point is the same as the corresponding operation of the ninth embodiment shown in FIG. 15. According to the present embodiment, earphone detector 408 outputs switching signal S403, which is the same as switching signal S402, to impedance switcher 409. Based on switching signal S403, impedance switcher 409 detects a line, that is presently being selected by selector switch 404 to recognize FM/TV antenna 404 or earphones 403 with a built-in VHF band antenna, as an antenna that is presently in use. Impedance switcher 409 changes its impedance to a value suitable for the antenna being used.

If a signal indicating that cellular phone 400 is receiving a VHF broadcast of TV or an FM broadcast is input to earphone detector 408 while earphones 403 with a built-in VHF band antenna are being connected to earphone connector 407, then earphone detector 408 switches selector switch 404 to earphones 403 with a built-in VHF band antenna. If a signal indicating that cellular phone 400 is receiving a UHF TV broadcast is input to earphone detector 408 while earphones 403 with a built-in VHF band antenna are being connected to earphone connector 407, then earphone detector 408 does not switch selector switch 404 to earphones 403 with a built-in VHF band antenna, but holds selector switch 404 connected to FM/TV antenna 392.

If earphones 403 with a built-in VHF band antenna are not connected to earphone connector 407, then earphone detector 408 does not switch selector switch 404 to earphones 403 with a built-in VHF band antenna, but holds selector switch 404 connected to FM/TV antenna 402. In this case, therefore, FM/TV antenna 402 receives all broadcasts and outputs them to TV/FM receiver 405.

According to the present embodiment thus arranged, an optimum antenna is used for better reception, the user can use the antenna device conveniently, and, in addition, an antenna to be used is optimized.

In the present embodiment arranged as described above, the types of antennas that are used for reception depending on the state of cellular phone 400 are shown in Table 6.

Table 6

With earphones Without earphones

UHF FM/TV antenna 402 FM/TV antenna 402

VHF/FM earphones 403 with built-in antenna for VHF band earphones 403 with built-in antenna for VHF band Embodiment 11

Figure 17:
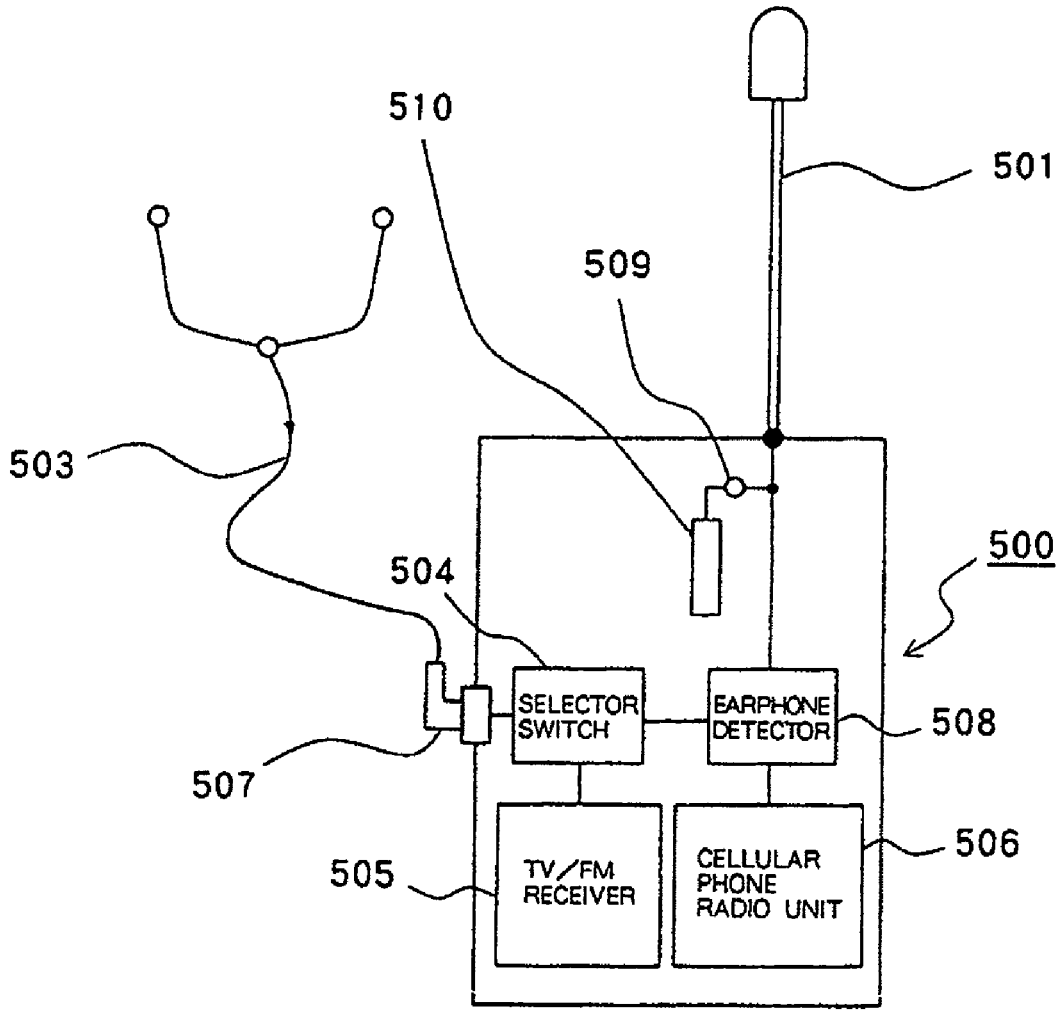
[FIG. 17] is a block diagram showing an essential arrangement according to an eleventh embodiment of the present invention.

FIG. 17 is a block diagram showing an essential arrangement according to an eleventh embodiment of the present invention.

Cellular phone 500 according to the present embodiment has selector switch 504, TV/FM receiver 505, cellular phone radio unit 506, earphone connector 507, and earphones 503 with a built-in VHF band antenna, which are connected to earphone connector 507 and which are identical to selector switch 204, TV/FM receiver 205, cellular phone radio unit 206, earphone connector 207, and earphones 203 with a built-in VHF band antenna as shown in FIG. 14, and will not be described below.

According to the present embodiment, cellular phone/TV/FM antenna 201 which is used to transmit and receive radio waves in the used band on the cellular phone and also to receive FM broadcasts and TV broadcasts in the VHF band and the UHF band according to the eighth embodiment, is replaced with cellular phone/TV/FM shared antenna 501. Cellular phone/TV/FM shared antenna 501, frequency filter 509, and second antenna 510 provide an antenna device having a combination of antennas that are selectively used as shown in the first through sixth embodiments.

Cellular phone/TV/FM shared antenna 501 comprises whip antenna 1 shown in FIG. 1 or a combination of whip antenna 1 and helical antenna 6 shown in FIG. 2. Second antenna 510 comprises coiled antenna 2 shown in FIG. 1, meander-line antenna 7 shown in FIG. 9, or meandering antenna 8 shown in FIG. 10.

Antenna output signals from cellular phone/TV/FM shared antenna 501 are used in the transmitting and receiving operation of cellular phone radio unit 506 and the receiving operation of the TV/FM receiver. Since cellular phone/TV/FM shared antenna 501 transmits and receives or receives broadcasts at low frequencies such as FM broadcasts and TV broadcasts, and radio waves at high frequencies used by the cellular phone, antenna output signals (corresponding to power feeder 3 shown in FIGS. 1 through 3 and FIGS. 8 through 12) from cellular phone/TV/FM shared antenna 501 are sent to frequency distributor 508, which divides the antenna output signals into broadcasts at low frequencies such as FM broadcasts and TV broadcasts and radio waves at high frequencies used by the cellular phone. Frequency distributor 508 sends broadcasts at low frequencies such as FM broadcasts and TV broadcasts to selector switch 504 and sends radio waves at high frequencies used by the cellular phone to cellular phone radio unit 506. Therefore, no mutual interference occurs between cellular phone radio unit 506 and TV/FM receiver 506. Other structural and operational details are identical to those of the eighth embodiment shown in FIG. 15.

With cellular phone 500 according to the present embodiment, signals in the UHF band are received by cellular phone/TV/FM shared antenna 501 based on a selective action made by the user, regardless of the connected state of earphones 503 with a built-in VHF band antenna. If earphones 503 with a built-in VHF band antenna are connected to earphone connector 507, then signals in the VHF band are received by earphones 503 with a built-in VHF band antenna. If earphones 503 with a built-in VHF band antenna are not connected to earphone connector 507, then signals in the VHF band are received by cellular phone/TV/FM shared antenna 501 and second antenna 510.

In the present embodiment arranged as described above, the types of antennas that are used for reception depending on the state of cellular phone 500 are shown in Table 7.

Table 7

With earphones Without earphones

UHF shared antenna 501 shared antenna 501

VHF/FM earphones 503 with built-in antenna for VHF band shared antenna 501+second antenna 510

Embodiment 12

Figure 18:
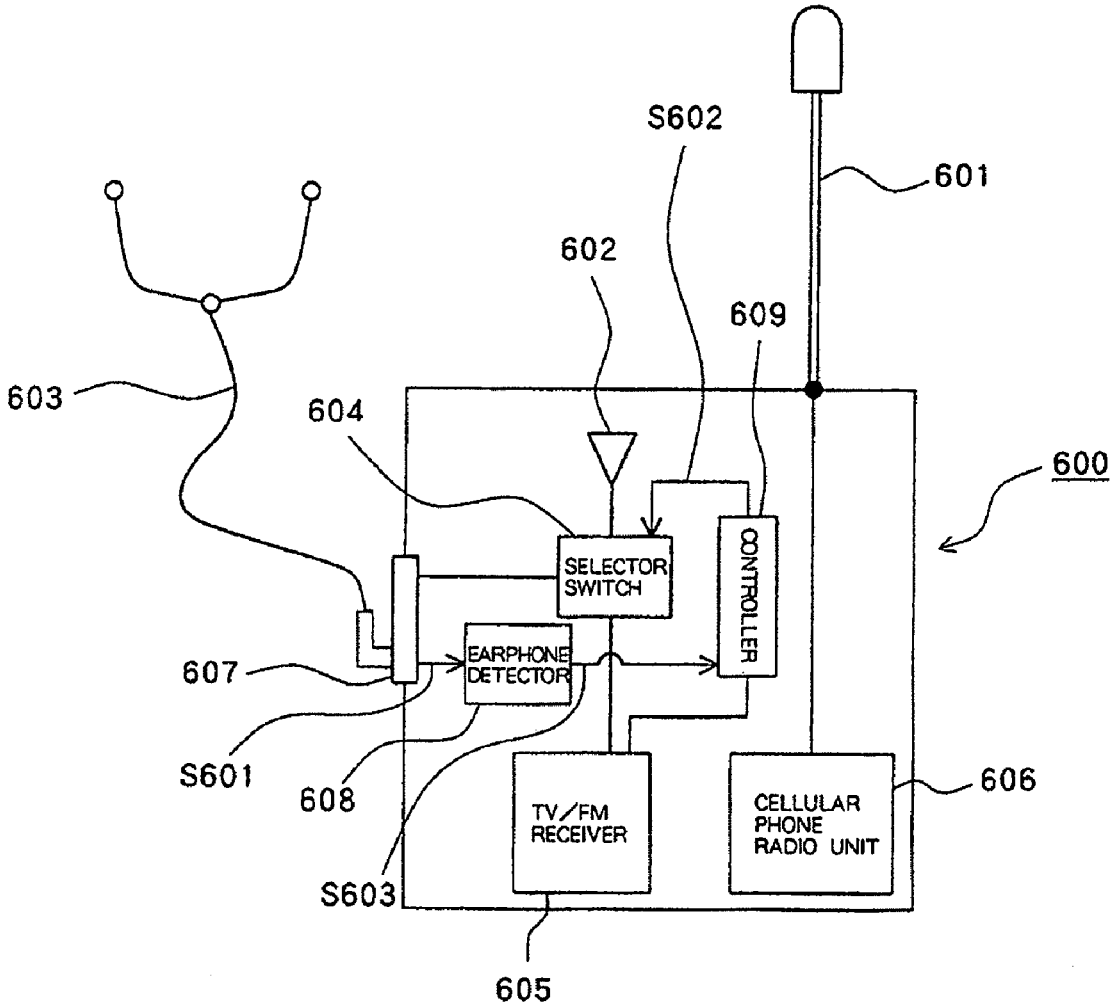
[FIG. 18] is a block diagram showing an essential arrangement according to a twelfth embodiment of the present invention.

FIG. 18 is a block diagram showing an essential arrangement according to a twelfth embodiment of the present invention.

Cellular phone 600 according to the present embodiment has cellular phone antenna 601, FM/TV antenna 602, earphones 603 with a built-in VHF band antenna, selector switch 604, TV/FM receiver 605, cellular phone radio unit 606, earphone connector 607, and earphone detector 608 which are identical to cellular phone antenna 301, FM/TV antenna 302, earphones 303 with a built-in VHF band antenna, selector switch 304, TV/FM receiver 305, cellular phone radio unit 306, earphone connector 307, and earphone detector 308 as shown in FIG. 15, and will not be described below.

In the present embodiment, controller 609 is provided for indicating a broadcast wave to be received by TV/FM receiver 605 and which is supplied with signal S603 output from earphone detector 608 and which indicates a detected state, and outputs switching signal S602 for switching to an antenna to be used depending on the detected state, to selector switch 604.

If earphone detector 608 detects when earphones 603 with a built-in VHF band antenna are connected to earphone connector 607, then earphone detector 608 sends signal S603 to controller 609 indicating that earphones 603 with a built-in VHF band antenna are connected to earphone connector 607. In response to signal S603 indicating that earphones 603 with a built-in VHF band antenna are connected to earphone connector 607, controller 609 confirms that a broadcast wave is to be received by TV/FM receiver 605. If controller 609 indicates that a VHF broadcast of TV or an FM broadcast to be received, then controller 609 sends a switching signal S602, to switch to earphones 603 with a built-in VHF band antenna, to selector switch 604, which then switches to earphones 603 with a built-in VHF band antenna.

Controller 609 also operates as a switcher. If controller 609 indicates that a UHF broadcast of TV is to be received when it receives signal S603 indicating that earphones 603 with a built-in VHF band antenna are connected to earphone connector 607, then controller 609 sends a switching signal S602, to switch to FM/TV antenna 602, to selector switch 604, which then remains connected to or switches to FM/TV antenna 602, and does not switch to earphones 603 with a built-in VHF band antenna.

If earphones 603 with a built-in VHF band antenna are not connected to earphone connector 607, then controller 609 sends a signal, to switch to FM/TV antenna 602, to selector switch 604, which remains connected to FM/TV antenna 602. In this case, FM/TV antenna 602 receives all broadcasts and outputs them to TV/FM receiver 605.

In the present embodiment arranged as described above, the types of antennas that are used for reception depending on the state of cellular phone 600 are shown in Table 8.

Table 8

With earphones Without earphones

UHF FM/TV antenna 602 FM/TV antenna 602

VHF/FM earphones 603 with built-in antenna for VHF band FM/TV antenna 602

Embodiment 13

Figure 19:
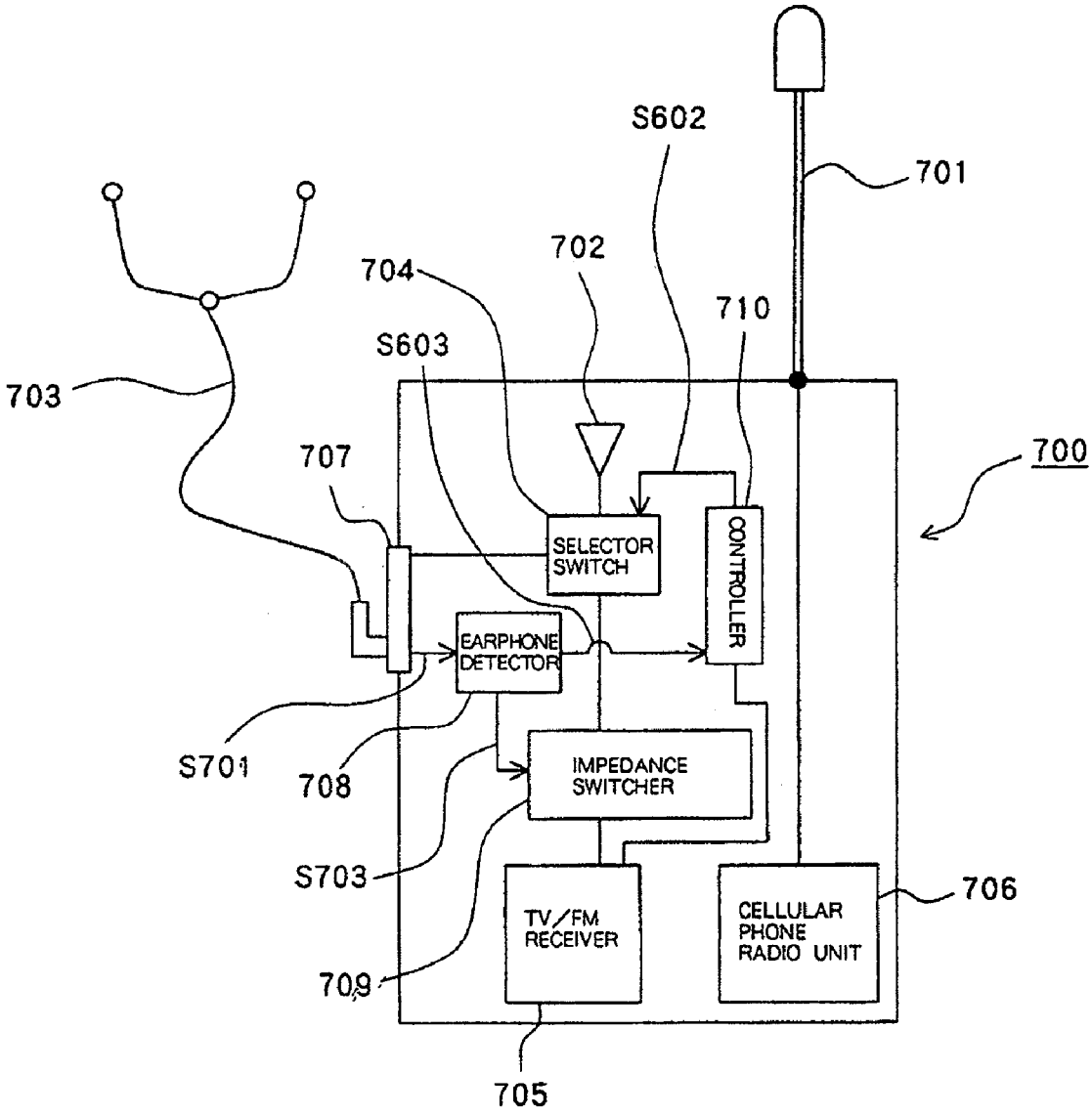
[FIG. 19] is a block diagram showing an essential arrangement according to a thirteenth embodiment of the present invention.

FIG. 19 is a block diagram showing an essential arrangement according to a thirteenth embodiment of the present invention.

Cellular phone 700 according to the present embodiment has cellular phone antenna 701, FM/TV antenna 702, earphones 703 with a built-in VHF band antenna, selector switch 704, TV/FM receiver 705, cellular phone radio unit 706, earphone connector 707, earphone detector 708, and impedance switcher 709 are identical to cellular phone antenna 401, FM/TV antenna 402, earphones 403 with a built-in VHF band antenna, selector switch 404, TV/FM receiver 405, cellular phone radio unit 406, earphone connector 407, earphone detector 408, and impedance switcher 409 as shown in FIG. 16, and will not be described below.

In the present embodiment, a controller 709 is provided for indicating a broadcast wave to be received by TV/FM receiver 705 and which is supplied with signal S703 output from earphone detector 708 and which indicates a detected state, and outputs switching signal S702 for switching to an antenna to be used depending on the detected state, to selector switch 704.

If earphone detector 708 detects when earphones 703 with a built-in VHF band antenna are connected to earphone connector 707, then earphone detector 708 sends signal S703 to controller 709 indicating that earphones 703 with a built-in VHF band antenna are connected to earphone connector 707. In response to signal S703 indicating that earphones 703 with a built-in VHF band antenna are connected to earphone connector 707, controller 709 confirms that a broadcast wave is to be received by TV/FM receiver 705. If controller 709 indicates that a VHF broadcast of TV or an FM broadcast to be received, then controller 709 sends switching signal S702, to switch to earphones 703 with a built-in VHF band antenna, to selector switch 704, which then switches to earphones 703 with a built-in VHF band antenna.

If controller 709 indicates a UHF broadcast of TV is to be received when it receives signal S703 indicating that earphones 703 with a built-in VHF band antenna are connected to earphone connector 707, then controller 709 sends switching signal S702 to switch to FM/TV antenna 702 to selector switch 704, which then keeps connected to or switches to FM/TV antenna 702, and does not switch to earphones 703 with a built-in VHF band antenna.

If earphones 703 with a built-in VHF band antenna are not connected to earphone connector 707, then controller 709 sends a signal, to switch to FM/TV antenna 702, to selector switch 704, which keeps connected to FM/TV antenna 702. In this case, FM/TV antenna 702 receives all broadcasts and outputs them to TV/FM receiver 705.

In the present embodiment arranged as described above, the types of antennas that are used for reception depending on the state of cellular phone 700 are shown in Table 7.

Table 7

With earphones Without earphones

UHF FM/TV antenna 702 FM/TV antenna 702

VHF/FM earphones 703 with built-in antenna for VHF band FM/TV antenna 702

Embodiment 14

Figure 20:
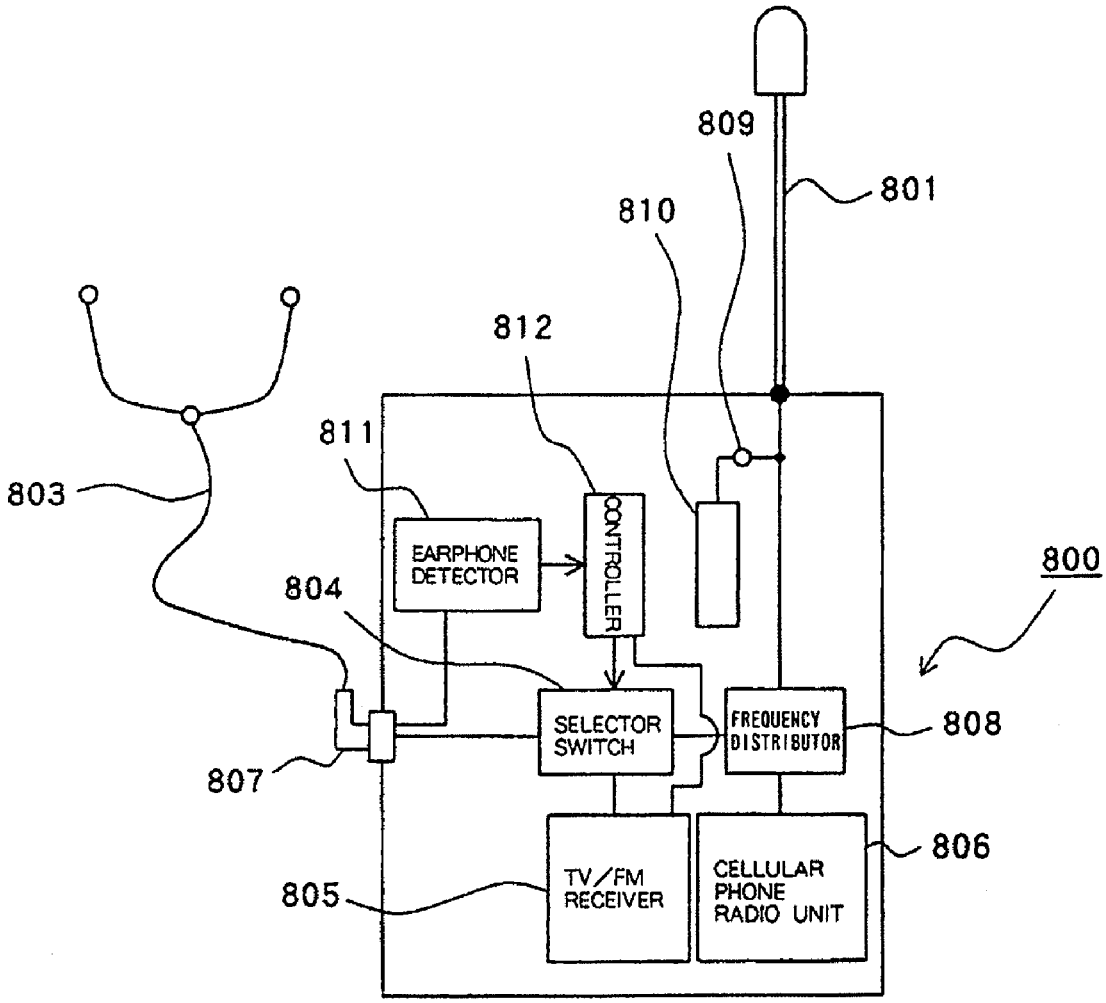
[FIG. 20] is a block diagram showing an essential arrangement according to a fourteenth embodiment of the present invention.

FIG. 20 is a block diagram showing an essential arrangement according to a fourteenth embodiment of the present invention.

Cellular phone 800 according to the present embodiment has cellular phone/TV/FM shared antenna 801, earphones 803 with a built-in VHF band antenna, selector switch 804, TV/FM receiver 805, cellular phone radio unit 806, earphone connector 807, frequency distributor 808, frequency filter 809, and second antenna 810 which are identical to cellular phone/TV/FM shared antenna 501, earphones 503 with a built-in VHF band antenna, selector switch 504, TV/FM receiver 505, cellular phone radio unit 506, earphone connector 507, frequency distributor 508, frequency filter 509, and second antenna 510 as shown in FIG. 17, and will not be described below.

The present embodiment has, in addition to the above arrangement, earphone detector 811 for detecting a connected state of earphones 803 with a built-in VHF band antenna with respect to earphone connector 807, and controller 812 for indicating a broadcast wave to be received by TV/FM receiver 805 and for controlling a switched state of selector switch 804 depending on the detected state from earphone detector 811 and a broadcast wave which is being presently received.

If earphone detector 811 detects when earphones 803 with a built-in VHF band antenna are connected to earphone connector 807, then earphone detector 811 sends a signal to controller 812 indicating that earphones 803 with a built-in VHF band antenna are connected to earphone connector 807. In response to the signal indicating that earphones 803 with a built-in VHF band antenna are connected to earphone connector 807, controller 812 confirms that a broadcast wave is to be received by TV/FM receiver 805. If controller 812 indicates a VHF broadcast of TV or an FM broadcast is to be received, then controller 812 sends a switching signal, to switch to earphones 803 with a built-in VHF band antenna, to selector switch 804, which then switches to earphones 803 with a built-in VHF band antenna.

If controller 812 indicates that a UHF broadcast of TV is to be received when it receives the signal indicating that earphones 803 with a built-in VHF band antenna are connected to earphone connector 807, then controller 812 sends a switching signal, to switch to an output line of frequency distributor 808, to selector switch 804, which then keeps connected to or switches to cellular phone/TV/FM shared antenna 801, and does not switch to earphones 803 with a built-in VHF band antenna.

If earphones 803 with a built-in VHF band antenna are not connected to earphone connector 807, then controller 812 sends a signal, to switch to frequency distributor 808, to selector switch 804, which remains connected to the output line of frequency distributor 808. In this case, cellular phone/TV/FM shared antenna 801 receives all broadcasts and outputs them to TV/FM receiver 805.

In the present embodiment arranged as described above, the types of antennas that are used for reception depending on the state of cellular phone 800 are shown in Table 10.

Table 10

With earphones Without earphones

UHF shared antenna 801 shared antenna 801

VHF/FM earphones 803 with built-in antenna for VHF band shared antenna 801+second antenna 810

With cellular phone 800 according to the present embodiment, as shown in Table 9, signals in the UHF band are received by cellular phone/TV/FM shared antenna 801 regardless of the connected state of earphones 803 with a built-in VHF band antenna. Signals in the VHF band are received by earphones 803 with a built-in VHF band antenna if earphones 803 with a built-in VHF band antenna are connected, and received by cellular phone/TV/FM shared antenna 801 if earphones 803 with a built-in VHF band antenna are not connected.

In the eighth, eleventh, and fourteenth embodiments shown in FIGS. 14, 17, and 20, the antenna of the cellular phone is used to send and receive radio waves in the frequency band used by the cellular phone, and is additionally used as the cellular phone/TV/FM shared antenna for receiving FM broadcasts and TV broadcasts in the VHF band the UHF band. The frequency distributor divides the antenna output signals into broadcasts at low frequencies such as FM broadcasts and TV broadcasts and radio waves at high frequencies used by the cellular phone. The frequency distributor sends broadcasts at low frequencies such as FM broadcasts and TV broadcasts to the selector switch and sends radio waves at high frequencies used by the cellular phone to the cellular phone radio unit.

If the frequency band used by the cellular phone and the frequency bands of FM broadcasts and TV broadcasts are close to each other, then the frequency distributor may not be provided, and the cellular phone/TV/FM shared antenna may be connected directly to the selector switch and the cellular phone radio unit. This arrangement is simpler in structure.

The arrangements shown in FIGS. 14, 17, and 20 may additionally have a line connecting the cellular phone/TV/FM shared antenna directly to the selector switch, without the frequency distributor interposed therebetween. If the frequency difference between an FM broadcast or a TV broadcast, that is selected, and the frequency band used by the cellular phone is greater than a predetermined threshold value, then the selector switch may select an output signal transmitted through the frequency distributor. If the frequency difference between an FM broadcast or a TV broadcast that is selected and the frequency band used by the cellular phone is smaller than the predetermined threshold value, then the selector switch may select the line connected to cellular phone/TV/FM shared antenna. The selector switch may determine whether the frequency difference is greater than the threshold value or not and also may control switching of the selector switch. Alternatively, a controller may be provided for performing such control.

In either one of the embodiments described above, the TV broadcast waves include digital broadcast waves, and the FM broadcast waves include FM radio broadcast waves.

What is claimed:

1. An antenna device for use with a cellular phone for communicating with a radio base station, comprising:

a first antenna extensible from a housing of the cellular phone;

a second antenna stored in the housing of the cellular phone; and a frequency filter;

wherein only said second antenna is connected to a power feeder with said frequency filter interposed therebetween; and wherein said first antenna is connected to said power feeder without said frequency filter interposed therebetween.

2. An antenna device for use with a cellular phone for communicating with a radio base station, comprising:

a first antenna storable in a housing of the cellular phone;

a second antenna stored in the housing of the cellular phone; and a third antenna mounted on a distal end of said first antenna and electrically insulated from said first antenna;

wherein only said second antenna is connected to a power feeder with a frequency filter interposed therebetween.

3. The antenna device for use with a cellular phone according to claim 2, wherein said first antenna or said third antenna is connected to said power feeder without said frequency filter interposed therebetween.

4. The antenna device for use with a cellular phone according to claim 2, wherein said third antenna comprises a helical antenna.

5. The antenna device for use with a cellular phone according to claim 2, wherein said antenna device operates as an antenna having two resonant states by having a state in which said third antenna functions alone and a state in which said third antenna and said second antenna function when said first antenna is stored.

6. An antenna device for use with a cellular phone for communicating with a radio base station, comprising:

a first antenna extensible from a housing of the cellular phone;

a second antenna stored in the housing of the cellular phone; and a frequency filter;

wherein only said second antenna is connected to a power feeder with said frequency filter interposed therebetween;

wherein said second antenna comprises a coiled antenna; and wherein said coiled antenna has a space for storing said first antenna therein.

7. An antenna device for use with a cellular phone for communicating with a radio base station, comprising:

a first antenna extensible from a housing of the cellular phone;

a second antenna stored in the housing of the cellular phone; and a frequency filter;

wherein only said second antenna is connected to a power feeder with said frequency filter interposed therebetween;

wherein said second antenna comprises a meander-line antenna; and wherein said meander-line antenna has a space for storing said first antenna therein.

8. An antenna device for use with a cellular phone for communicating with a radio base station, comprising:

a first antenna extensible from a housing of the cellular phone;

a second antenna stored in the housing of the cellular phone; and a frequency filter;

wherein only said second antenna is connected to a power feeder with said frequency filter interposed therebetween; and wherein said second antenna comprises a meander-line antenna having a hollow semicylindrical shape or an inverted U-shaped cross section to provide a space for storing said first antenna therein, said meander-line antenna being fixed along a surface of a board and positioned to accommodate said first antenna therein.

9. An antenna device for use with a cellular phone for communicating with a radio base station, comprising:

a first antenna extensible from a housing of the cellular phone;

a second antenna stored in the housing of the cellular phone; and a frequency filter;

wherein only said second antenna is connected to a power feeder with said frequency filter interposed therebetween; and wherein said second antenna is of a slender shape having a hollow semicylindrical or inverted U-shaped cross section perpendicular to a longitudinal direction thereof, with an open side of the hollow semicylindrical or U-shaped antenna being fixed to a board, providing a space for storing said first antenna therein.

10. An antenna device for use with a cellular phone for communicating with a radio base station, comprising:

a first antenna extensible from a housing of the cellular phone;

a second antenna stored in the housing of the cellular phone; and a frequency filter;

wherein only said second antenna is connected to a power feeder with said frequency filter interposed therebetween;

wherein said first antenna comprises a whip antenna and is connected to the power feeder when extended.

11. The antenna device for use with a cellular phone according to claim 10, wherein said first antenna functions alone at frequencies in a UHF band or higher, and said first antenna and said second antenna function at frequencies in a VHF band or lower when connected to each other through said frequency filter.

12. The antenna device for use with a cellular phone according to claim 11, wherein said third antenna functions alone at frequencies in the UHF band or higher, and said second antenna and said third antenna function at frequencies in the VHF band or lower.

13. The radio unit for receiving broadcast waves, comprising:

an antenna device for use with a cellular phone for communicating with a radio base station, and for sending and receiving radio waves in a frequency band used by a cellular phone and for receiving TV broadcast waves including an UHF band and a VHF band and FM broadcast waves, the antenna device comprising:

a first antenna extensible from a housing of the cellular phone;

a second antenna stored in the housing of the cellular phone; and a frequency filter;

wherein only said second antenna is connected to a power feeder with said frequency filter interposed therebetween;

an earphone connector;

a TV/FM receiver for demodulating received TV broadcast waves including the UHF band and the VHF band and received FM broadcast waves;

a frequency distributor for dividing radio waves received by said antenna device into radio waves in the frequency band used by the cellular phone and TV broadcast waves and FM broadcast waves; and a switcher for selectively connecting either one of an output terminal for outputting TV broadcast waves and FM broadcast waves divided by said frequency distributor and said earphone connector to said TV/FM receiver.

14. A radio unit for receiving broadcast waves, comprising:

an antenna device for use with a cellular phone for communicating with a radio base station and for sending and receiving radio waves in a frequency band used by a cellular phone and receiving TV broadcast waves including an UHF band and a VHF band and FM broadcast waves, the antenna device comprising:

a first antenna extensible from a housing of the cellular phone;

a second antenna stored in the housing of the cellular phone; and a frequency filter;

wherein only said second antenna is connected to a power feeder with said frequency filter interposed therebetween;

an earphone connector;

a receiver for receiving broadcast waves including at least one of the UHF band and the VHF band which have been received;

a frequency distributor for dividing radio waves received by said antenna device into radio waves in the frequency band used by the cellular phone and broadcast waves; and a switcher for selectively connecting either one of an output end for outputting broadcast waves divided by said frequency distributor and said earphone connector to said receiver.

15. A radio unit for communicating with a radio base station, comprising:

a first antenna mounted on a housing of the radio unit, for receiving TV broadcast waves;

a second antenna stored in the housing of the cellular phone, for receiving TV broadcast waves;

a power feeder connected directly to said first antenna and connected to said second antenna through said frequency filter;

a frequency distributor connected to said power feeder, for dividing radio waves received by said first antenna and said second antenna into radio waves in a frequency band used by a cellular phone and TV broadcast waves;

a receiver for receiving TV broadcast waves;

a frequency filter for passing a VHF band therethrough;

an earphone connector;

an earphone detector for detecting a connected state of earphones with respect to said earphone connector; and a switcher for connecting said earphone connector to said receiver if said earphone detector detects when earphones are connected to said earphone connector while said receiver is receiving broadcast waves in the VHF band.

16. The radio unit according to claim 15, further comprising:

a third antenna mounted on a distal end of said first antenna and electrically insulated from said first antenna.

17. The radio unit according to claim 16, wherein said third antenna comprises a helical antenna.

18. The radio unit according to claim 16, wherein said radio unit operates as an antenna having two resonant states by having a state in which said third antenna functions alone and a state in which said third antenna and said second antenna function when said first antenna is stored.

19. The radio unit according to claim 16, wherein said third antenna functions alone at frequencies in a UHF band or higher, and said second antenna and said third antenna function at frequencies in a VHF band or lower.

20. The radio unit according to claim 15, wherein said first antenna comprises a whip antenna and is connected to the power feeder when extended.

21. The radio unit according to claim 15, wherein said radio unit operates as an antenna having two resonant states by having a state in which said first antenna functions alone and a state in which said first antenna and said second antenna function when connected to each other through said frequency filter.

22. The radio unit according to claim 15, wherein said first antenna functions alone at frequencies in a UHF band or higher, and said first antenna and said second antenna function at frequencies in a VHF band or lower when connected to each other through said frequency filter.

23. The radio unit according to claim 15, wherein said second antenna comprises a coiled antenna.

24. The radio unit according to claim 15, wherein said second antenna comprises a meander-line antenna.

25. A radio unit for communicating with a radio base station, comprising:

a first antenna mounted on a housing of the radio unit, for receiving TV broadcast waves;

a second antenna stored in the housing of the cellular phone, for receiving TV broadcast waves;

a power feeder connected directly to said first antenna and connected to said second antenna through said frequency filter;

a frequency distributor connected to said power feeder, for dividing radio waves received by said first antenna and said second antenna into radio waves in a frequency band used by a cellular phone and TV broadcast waves;

a receiver for receiving TV broadcast waves;

a frequency filter for passing a VHF band therethrough;

an earphone connector;

an earphone detector for detecting a connected state of earphones with respect to said earphone connector; and a switcher for connecting an output terminal of said frequency distributor for outputting TV broadcast waves to said receiver while said receiver is receiving broadcast waves in a UHF band.

26. A radio unit for communicating with a radio base station, comprising:

a first antenna mounted on a housing of the radio unit, for receiving TV broadcast waves;

a second antenna stored in the housing of the cellular phone, for receiving TV broadcast waves;

a power feeder connected directly to said first antenna and connected to said second antenna through said frequency filter;

a frequency distributor connected to said power feeder, for dividing radio waves received by said first antenna and said second antenna into radio waves in a frequency band used by a cellular phone and TV broadcast waves;

a receiver for receiving TV broadcast waves;

a frequency filter for passing a VHF band therethrough;

an earphone connector;

an earphone detector for detecting a connected state of earphones with respect to said earphone connector; and a switcher for connecting an output terminal of said frequency distributor for outputting TV broadcast waves to said receiver if said earphone detector detects when earphones are not connected to said earphone connector while said receiver is receiving broadcast waves in the VHF band.

27. A radio unit for communicating with a radio base station, comprising:

a first antenna mounted on a housing of the radio unit, for receiving TV broadcast waves;

a second antenna stored in the housing of the cellular phone, for receiving TV broadcast waves;

a power feeder connected directly to said first antenna and connected to said second antenna through said frequency filter;

a frequency distributor connected to said power feeder, for dividing radio waves received by said first antenna and said second antenna into radio waves in a frequency band used by a cellular phone and TV broadcast waves;

a receiver for receiving TV broadcast waves;

a frequency filter for passing a VHF band therethrough;

an earphone connector;

an earphone detector for detecting a connected state of earphones with respect to said earphone connector; and a switcher for connecting said earphone connector to said receiver if said earphone detector detects when earphones are connected to said earphone connector while said receiver is receiving broadcast waves in the VHF band, connecting an output terminal of said frequency distributor for outputting TV broadcast waves to said receiver while said receiver is receiving broadcast waves in a UHF band, and connecting said power feeder to said receiver if said earphone detector detects when earphones are not connected to said earphone connector while said receiver is receiving broadcast waves in the VHF band.

* * * * *